US010233005B1

(12) United States Patent
De Bonet

(10) Patent No.: US 10,233,005 B1
(45) Date of Patent: Mar. 19, 2019

(54) AIR-PADDED CONTAINERS

(71) Applicant: Amazon Technologies, Inc., Seattle, WA (US)

(72) Inventor: Jeremy Samuel De Bonet, Southborough, MA (US)

(73) Assignee: Amazon Technologies, Inc., Seattle, WA (US)

( * ) Notice: Subject to any disclaimer, the term of this patent is extended or adjusted under 35 U.S.C. 154(b) by 652 days.

(21) Appl. No.: 14/754,555

(22) Filed: Jun. 29, 2015

(51) Int. Cl.

| | |
|---|---|
| ***B65D 81/03*** | (2006.01) |
| ***B65D 81/05*** | (2006.01) |
| ***B65B 5/04*** | (2006.01) |
| ***B65B 7/26*** | (2006.01) |
| ***B65B 55/20*** | (2006.01) |
| ***B65B 43/10*** | (2006.01) |

(52) U.S. Cl.
CPC ..... *B65D 81/052* (2013.01); *B65B 5/04* (2013.01); *B65B 7/26* (2013.01); *B65B 43/10* (2013.01); *B65B 55/20* (2013.01)

(58) Field of Classification Search
CPC ..... B65D 81/052; B65D 81/051; B65D 81/03
USPC ..... 206/522
See application file for complete search history.

(56) References Cited

U.S. PATENT DOCUMENTS 4,573,202 A * 2/1986 Lee ..... A45C 3/00 190/107
5,588,533 A * 12/1996 Farison ..... B65D 81/052 206/522
6,253,919 B1 * 7/2001 Sperry ..... B60P 7/065 206/522
8,281,928 B2 * 10/2012 Smith ..... B65D 81/052 206/522

* cited by examiner

*Primary Examiner* — King M Chu
(74) *Attorney, Agent, or Firm* — Athorus, PLLC

(57) ABSTRACT

Containers such as boxes or tubes may be lined with deflated air bladders or reservoirs. When an item is placed in such a container, the container may be sealed, and the air bladders or reservoirs may be charged with air until such bladders or reservoirs surround and fully cushion the item within the container. The bladders or reservoirs may be formed from lightweight and flexible materials, such as polyethylenes, polyphenylenes or other plastics, and charged with air manually or automatically from an external source via a valve or other component extending through the containers. An internal pressure within one or more of the bladders or reservoirs may be monitored during the charging, and the charging may be secured when the internal pressure meets or exceeds a predetermined threshold.

12 Claims, 20 Drawing Sheets

AIR-PADDED CONTAINERS

BACKGROUND

Items are commonly delivered from sources to destinations by mail, common carrier or means, and by any single mode of transit (e.g., by land, sea and/or air transit), or by two or more modes of transit. For example, when an item purchased by a customer is to be delivered from a warehouse or like facility to a location designated by the customer, the item is placed into a container along with one or more types of dunnage and, optionally, one or more other items. Some examples of the dunnage that may accompany an item in a container include packing materials formed from paper, wood, fabric, plastic or foam.

Dunnage acts as a valuable layer of security between an item and an interior surface of a container in which the item is to be delivered. In particular, dunnage shields external surfaces of the item against collisions with the inner walls or other layers of the container when the container is subjected to shocks, impacts or other adverse events that may occur while preparing the container for shipment, loading the container onto a vehicle, unloading the container from the vehicle, transporting the item from the vehicle to an intended destination, or at any other stage of the delivery process.

Despite its inherent advantages, the use or inclusion of dunnage when preparing items for delivery is occasionally accompanied by one or more challenges or complications. For example, it is frequently difficult to determine precisely how much dunnage, or what type of dunnage, should be included with an item in a given container. Where too much dunnage is included in a container, closing or sealing the container may be difficult, and the risk of breach or failure during delivery will likely increase. Moreover, the risk that the item will be damaged upon arrival also increases when a container is overstuffed with excess dunnage. When not enough dunnage is included in a container, the probability that an item will be damaged if the container is subjected to shocks, impacts or other adverse events increases. Moreover, including dunnage in a container necessarily slows processes by which an item is prepared for delivery to a customer. Furthermore, including dunnage in a container also naturally results in the delivery of additional mass from a source to a destination. Unless the dunnage is reusable or recyclable, and is either reused or recycled, the additional mass included in an individual delivery may end up in a landfill or other trash processing facility. Additionally, the net effect of the additional mass included in large-scale deliveries is a substantial increase in the amount of fuel required to complete such deliveries substantial amounts of additional fuel to be expended

DETAILED DESCRIPTION

Figure 1B:
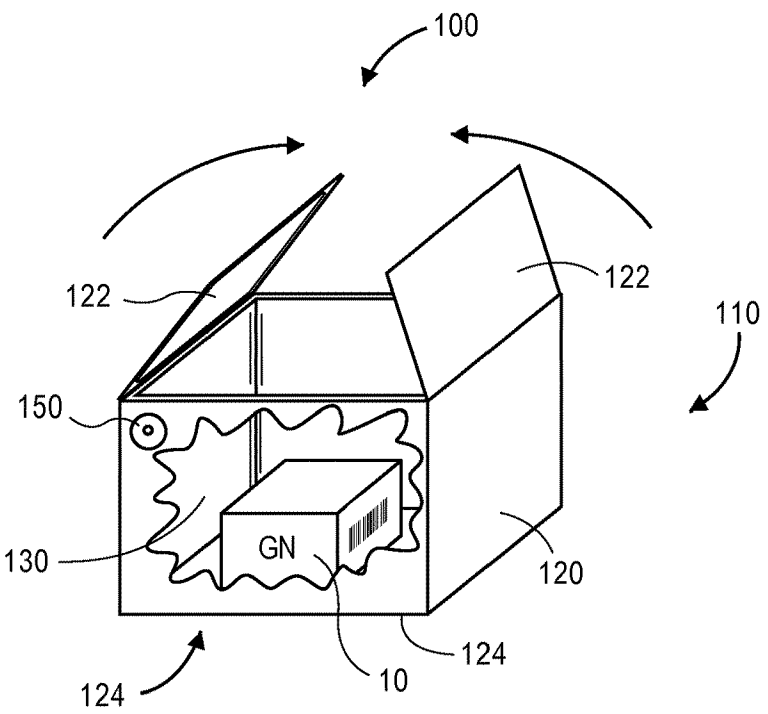
FIGS. 1A through 1E are views of aspects of one air-padded container in accordance with embodiments of the present disclosure.

As is set forth in greater detail below, the present disclosure is directed to air-padded containers for delivering items from sources to destinations. Air-padded containers of the present disclosure may be traditional shipping containers such as boxes, tubes, envelopes or cartons, as well as other apparatuses for transporting items including but not limited to backpacks, handbags, luggage or other similar containers, or even vehicles. Air-padded containers of the present disclosure may include one or more inflatable reservoirs, chambers, bladders, cushions, tanks or other vessels that may be charged, pumped, blown or otherwise supplied with air or another suitable fluid from external sources such as compressors, pumps or mouth-blown straws. Such vessels may therefore act as a lightweight, low cost and easily employed replacement for traditional dunnage that ordinarily accompanies items being delivered in such containers or vehicles.

Air-padded containers of the present disclosure may also include charging valves, e.g., check valves, which extend through such containers and are configured to not only enable air or other fluids to be charged, pumped, blown or otherwise supplied therein from external sources, but also resist the release of air or other fluids from such vessels after the charging, pumping, blowing or supplying is complete. During the inflation of such vessels, one or more pressure monitoring systems or techniques may be utilized to ensure that charging, pumping, blowing or supplying is isolated when a predetermined pressure threshold is reached, such as regulators, sensors, gauges or meters, in order to avoid damaging the containers, vessels or items therein. Air-padded containers of the present disclosure may be formed from container blanks that are prefabricated to include not only the external walls or other components of a traditional container but also any components or features required to prepare or inflate one or more reservoirs, chambers, bladders, cushions, tanks or other vessels.

Thus, in accordance with the present disclosure, an item may be placed into an air-padded container and sealed therein. Subsequently, after the item has been sealed within the air-padded container, one or more reservoirs, chambers, bladders, cushions, tanks or other vessels may be charged, pumped, blown or otherwise supplied with air or another fluid from an external source. Once such vessels are charged, pumped, blown or otherwise supplied to an appropriate pressure or volume, the container may be reliably delivered from a source to a destination, with such vessels acting as an inexpensive yet efficient substitute for traditional dunnage formed from paper, wood, fabric, plastic or foam, or other like materials.

Referring to FIGS. 1A through 1E, views of aspects of one air-padded container 100 in accordance with embodiments of the present disclosure are shown. The air-padded container 100 may be formed from a container blank including a substrate 110, at least one hermetic layer 130 and at least one charging valve 150. The substrate 110 may be formed from any suitable materials including but not limited to papers, cardboards, plastics, rubbers, leathers, canvases, woven fabrics (e.g., fabrics comprising one or more plastic, cotton, paper or other fibers) or non-woven fabrics or like materials. The substrate 110 may be cut and/or otherwise formed to include a plurality of side panels 120, top panels 122 or bottom panels 124. The hermetic layer 130 may then be sealed to inner surfaces of the substrate 110 in order to define an inflatable reservoir 115 between the hermetic layer 130 and an inner surface of the substrate 110. The charging valve 150 extends through the substrate 110 and provides a flow path from outside of the substrate 110 into the inflatable reservoir 115.

Figure 1A:
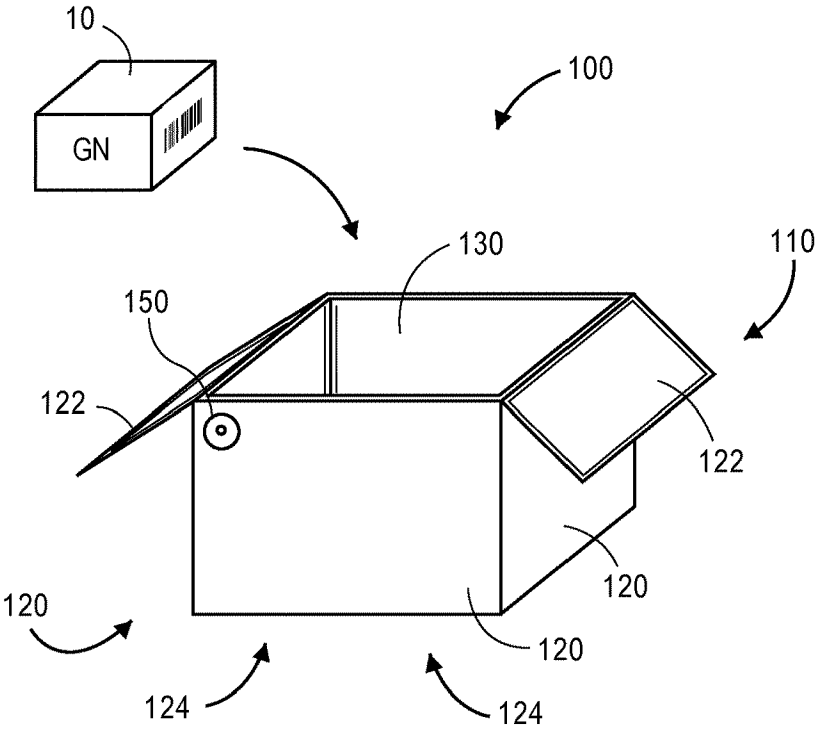
Figure 1D:
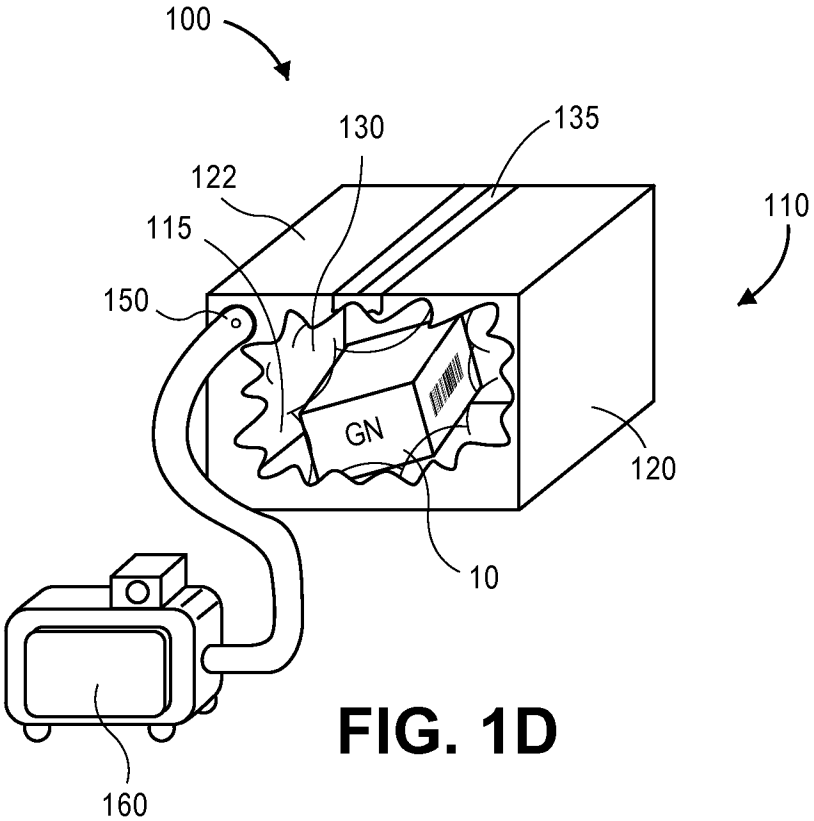
Figure 1C:
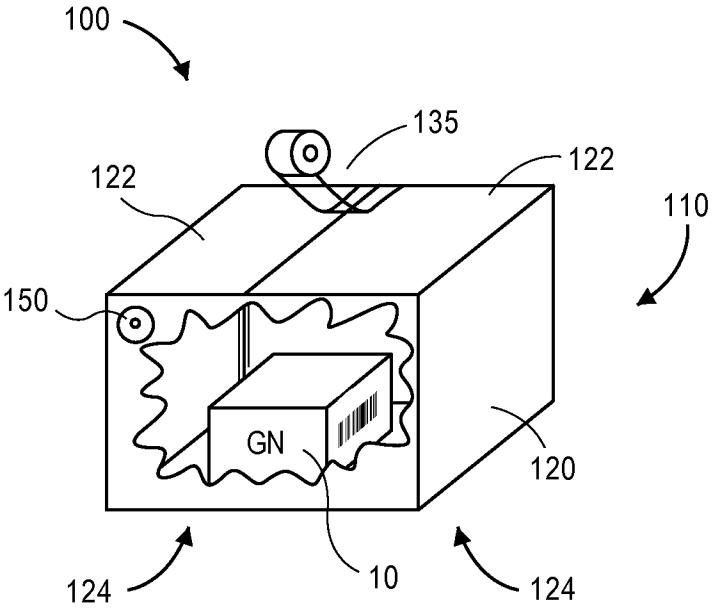

Referring to FIG. 1A, when the substrate 110 is folded into the form of a box or other three-dimensional hollow container 100, an item 10 may be placed therein, e.g., on a bottom or other inner surface of the container 100. Referring to FIG. 1B, the container 100 may be closed, such as by folding one or more top panels 122 over with the item 10 resting on a bottom of the container 100, e.g., atop one or more portions of the hermetic layer 130. Referring to FIG. 1C, after the container 100 has been closed with the item 10 therein, resting on one or more portions of the hermetic layer 130, the container 100 may be sealed using an adhesive tape 135 or other materials (e.g., glues, pastes or binders such as elastics, straps, staples or bands).

Figure 1E:
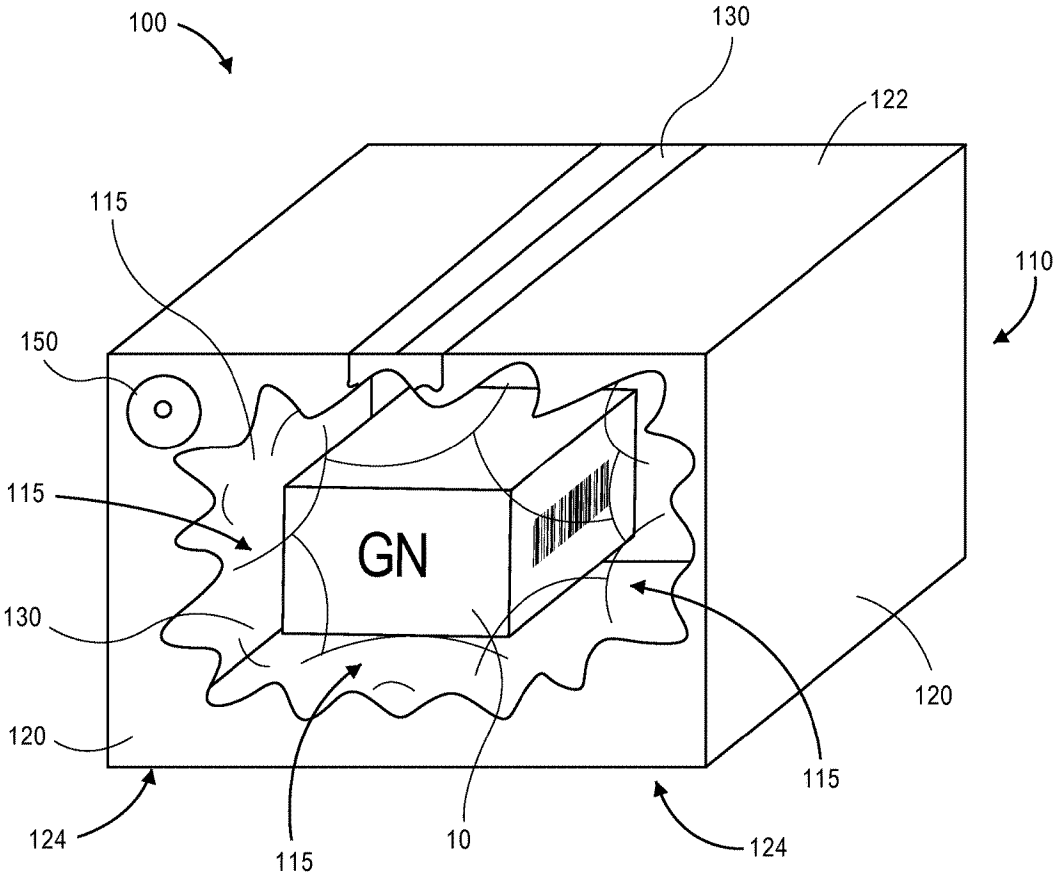

In accordance with the present disclosure, inflatable reservoirs provided on one or more inner surfaces of a sealed container may be charged with air or other fluids from external sources, thereby suspending or padding an item provided therein. Referring to FIG. 1D, a compressor 160 or other pressure source charges air into the inflatable reservoir 115 via the charging valve 150, and the item 10 therein is lifted above a bottom of the container 100, as the inflatable reservoir 115 expands in volume and as pressure rises within the inflatable reservoir 115. When the pressure within the inflatable reservoir 115 reaches a predetermined threshold, the charging may be secured, and the compressor 160 or other pressure source may be removed. Referring to FIG. 1E, when the inflatable reservoir 115 is filled with air at a suitable pressure, the item 10 is suspended within the container 100, between or in contact with one or more portions of the hermetic layer 130. Thus, with the item 10 sealed and suspended therein, the container 100 may be delivered to an intended destination by hand, by mail, by common carrier (e.g., Federal Express, United Parcel Service) or by any other delivery means, including one or more cars, trucks, trailers, freight cars, container ships or cargo aircraft (e.g., manned aircraft or unmanned aircraft, such as drones).

Accordingly, the systems and methods of the present disclosure may utilize or comprise one or more air-padded containers including on or more inflatable reservoirs or other like vessels provided therein. In order to prepare an item for delivery, the item may be placed into an air-padded container and sealed. The inflatable reservoirs may then be charged with air from external sources, e.g., pumps, compressors or humans, and, once inflated to a predetermined or suitable pressure, provide a flexible barrier of dunnage between the item and the inner surfaces of the container. In some implementations, by providing a container having an inflatable reservoir into which air may be charged after an item has been sealed therein, the item may be transported or stored within the container without requiring any additional dunnage. Alternatively, additional dunnage of any type or form may be provided along with an item when the item is sealed within a container, and both the additional dunnage and the item may be enshrouded or enveloped by the inflatable reservoir within the container.

Furthermore, the sufficiency of protection may be determined based on a pressure threshold, e.g., a pressure of air or another fluid within an inflatable reservoir, and not a mass threshold or dimension threshold, the systems and methods of the present disclosure may be utilized in connection with containers and/or items of any size, shape or form. Thus, the air-padded containers of the present disclosure may include bags, barrels, bins, boxes, cartons, crates, envelopes, luggage, tubes, or any other apparatuses or systems in which items may be transported or stored.

Those of ordinary skill in the pertinent arts will recognize that terms such as "charge" (or "charging" or "charged"), "pump" (or "pumping" or "pumped"), "blow" (or "blowing" or "blown"), "supply" (or "supplying" or "supplied"), or like terms, shall refer to the injection of air or other fluids into a reservoir, a chamber, a bladder, a cushion, a tank or another vessel by a machine, a human (or another animal), or by any other source of air or the other fluids. For example, air or other fluids may be charged, pumped, blown or supplied to such a reservoir, a chamber, a bladder, a cushion, a tank or another vessel using an automatic or a manual pump, or by a mouth-blown straw or other oral inflation device, in accordance with the present disclosure.

The air-padded containers of the present disclosure, including but not limited to the container 100 of FIGS. 1A through 1E, provides a number of advantages as compared to containers or dunnage of the prior art. For example, by including built-in, inflatable reservoirs, chambers, bladders, cushions, tanks or other vessels within containers, a customized and form-fitting layer of dunnage may be provided around items being transported or stored within such containers. Dunnage of increasingly larger volumes or heavier masses may be replaced with inflatable reservoirs or like vessels formed from one or more flexible layers secured to interior surfaces of containers, thereby alleviating hassles or messes associated with packing dunnage into containers at their sources, or removing dunnage from the containers at their destinations. Moreover, when air is charged into an inflatable reservoir provided on one or more surfaces within a sealed container having an item therein, the inflatable reservoir is likely to enshroud or envelop the item within the container, and result in a substantial centering of the item. Furthermore, the pressure of the air within the inflatable reservoir may be monitored to ensure that an appropriate layer of protection is provided around the item, and that the inflatable reservoir is neither over-inflated nor under-inflated with respect to its intended purpose.

The air-padded containers of the present disclosure may be formed from container blanks that include inflatable reservoirs, chambers, bladders, cushions, tanks or other vessels provided on portions of surfaces of substrates or other layers that may be folded, rolled or otherwise shaped or assembled into containers for transporting one or more items therein. Referring to FIGS. 2A through 2F, aspects of one container blank 205 for forming an air-padded container in accordance with embodiments of the present disclosure are shown. Except where otherwise noted, reference numerals preceded by the number "2" shown in FIGS. 2A through 2F indicate components or features that are similar to components or features having reference numerals preceded by the number "1" shown in FIGS. 1A through 1E.

Figure 2A:
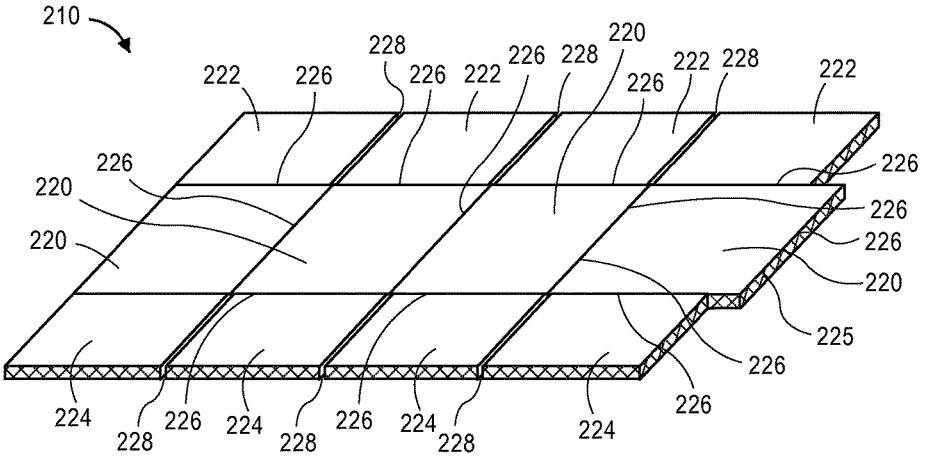
FIGS. 2A through 2F are views of aspects of one container blank for forming an air-padded container in accordance with embodiments of the present disclosure.

Referring to FIG. 2A, the container blank 205 may be formed from a substrate 210 that may be formed, shaped or otherwise processed in a manner that enables the substrate 210 to be folded, rolled or otherwise shaped or assembled into a container for one or more items. For example, the substrate 210 of FIG. 2A has been cut and/or scored to be subsequently folded or formed into a rectangular container. The substrate 210 includes four side panels (or faces) 220, as well as four top panels (or flaps or crenellations) 222 and four bottom panels (or flaps or crenellations) 224 joined to each of the side panels 220, and a sealing edge (or sealing panel) 225. The substrate 210 also includes scores (or scored lines) 226 extending between the side panels 220 and the top panels 222 or bottom panels 224, or between two side panels 220. The scores 226 enable the substrate 210 to be folded or creased to form the rectangular container. In some implementations, the scores 226 may comprise recesses or indentations on a first side of the substrate 210 corresponding to an inner surface of a container to be formed therefrom. In some other implementations, the scores 226 may comprise a raised line or line segment on a second side of the substrate 210 corresponding to an outer surface of the container to be formed therefrom. Additionally, the substrate 210 also includes crenels 228 between each of the top panels 222 and each of the bottom panels 224. The sealing edge 225 is joined to one of the side panels 220 and, when the substrate 210 is folded or creased to form the rectangular container, may be joined or sealed to another of the side panels 220.

The substrate 210 may be formed from any type or form of materials, of any shape or size. For example, the substrate 210 may be formed from one or more papers (e.g., coated or uncoated stocks of various papers such as bond), cardboards (e.g., boxboards, carton boards, chipboards or other like materials having one or more layers, including but not limited to corrugated fiberboards having flat layers and intervening fluted layers), plastics (e.g., polyethylenes, polypropylenes, polystyrenes and polyvinyl chlorides), rubbers (e.g., natural or synthetic rubbers such as acrylics, butadiene rubbers, butyl rubbers, chloroprenes, fluorocarbons, fluoroelastomers, fluorosilicones, monomers of ethylenes or propylenes, nitrile rubbers, perfluoroelastomers, polyethylenes, polyurethanes, silicone rubbers, styrene rubbers), woods (e.g., hardwoods such as cherry, mahogany, maple, oak, rosewood, teak or walnut, or softwoods such as ash, beech, birch, cedar, fir, hemlock, hickory, pine, redwood or spruce) or metals (e.g., aluminum, brass, copper, steel, titanium or alloys thereof), or the like. Moreover, the substrate 210 may be formed as a composite material from two or more different materials (e.g., two different papers or rubbers), or two or more types of materials (e.g., laminated paper or reinforced metals).

The locations and numbers of the scores 226 or the crenels 228, as well as the numbers, sizes or shapes of the side panels 220, the top panels 222 or the bottom panels 224, may be selected on any basis. For example, where a substrate is to be prepared for forming a six-sided container, e.g., the substrate 210 of FIG. 2A, three crenels may be cut into each of the top and/or bottom edges of the container. Where the substrate is to be prepared for forming a cylindrical container, crenels need not be provided. Similarly, when a substrate 210 is to be ultimately formed into a shape of a three-dimensional object (e.g., a prism or rectangular solid), any number of scores or scoring lines may be provided thereon. Furthermore, one or more sealing edges or other features for joining open ends of panels may be provided in accordance with the present disclosure. Any type or form of modifications to the size, shape or orientation of a substrate may be performed when forming the substrate for the purpose of ultimately creating a specific container in accordance with the present disclosure.

Figure 2B:
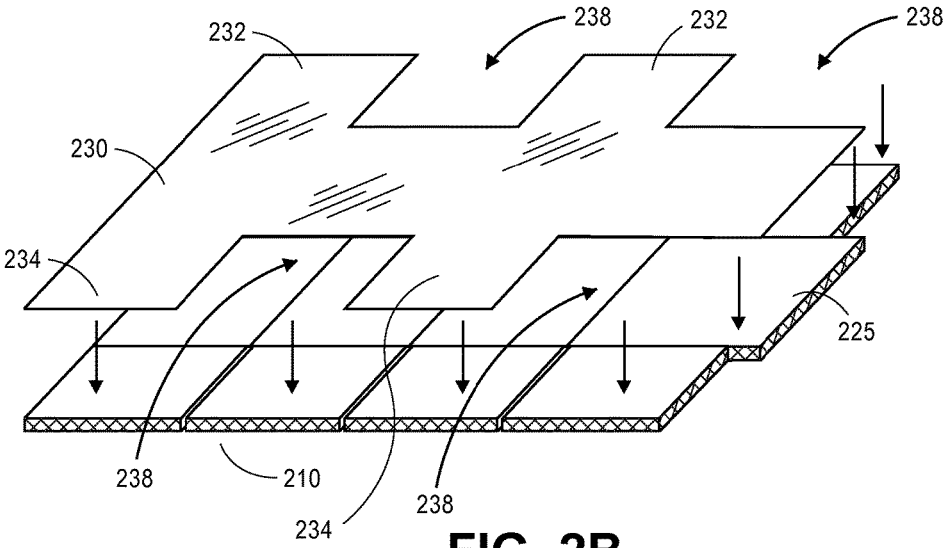

As is discussed above, when forming a container blank in accordance with the present disclosure, an inflatable reservoir may be adhered to one or more surfaces of a substrate that would correspond, when assembled, to an interior surface of a container. The inflatable reservoir may be formed from one or more flexible layers applied thereto which may, when inflated with air or another fluid, define the inflatable reservoir and act as a layer of dunnage provided between an item and an inner surface of the container. Referring to FIG. 2B, a first flexible layer 230 is applied to the substrate 210 of FIG. 2B. The first flexible layer 230 may be cut and/or shaped to correspond to at least a portion of a first surface of the substrate 210. For example, as is shown in FIG. 2B, the first flexible layer 230 includes top panels 232 corresponding to two of the four top panels 222 of the substrate 210, and bottom panels 234 corresponding to two of the four bottom panels 224 of the substrate 234, with crenels 238 separating each of the two top panels 232 and each of the two bottom panels 234.

By covering just two of the top panels 222, and just two of the bottom panels 224, with the top panels 232 and the bottom panels 234, respectively, the first flexible layer 230 may define a reservoir that, when the substrate 210 is formed into a container and inflated, acts as dunnage in forming a protective layer between the container and any contents therein. The reservoir may be formed by the surface area defined by an outer perimeter of the substrate 210, and any crenels 228 or other modifications thereto, as well as the first flexible layer 230 and any corresponding modifications thereto, such as one or more crenels 238. The first flexible layer 230 may be applied in a vertical or perpendicular manner, such as is shown in FIG. 2B, or in any other manner, e.g., by rolling the first flexible layer 230 horizontally or in parallel thereon.

The first flexible layer 230 may be formed from any suitable material that may be shaped or formed to define an inflatable reservoir within a container, and joined to one or more interior surfaces of the container. For example, the first flexible layer 230 may be formed from acrylic, latexes, nylons, polychloroprenes, polyesters, polyethylenes, polypropylenes, polyurethanes, polyvinyl chlorides, styrenes or other like and suitably flexible materials that may be sealed or joined to substrate or to another flexible layer, in order to define one or more inflatable reservoirs.

Figure 2C:
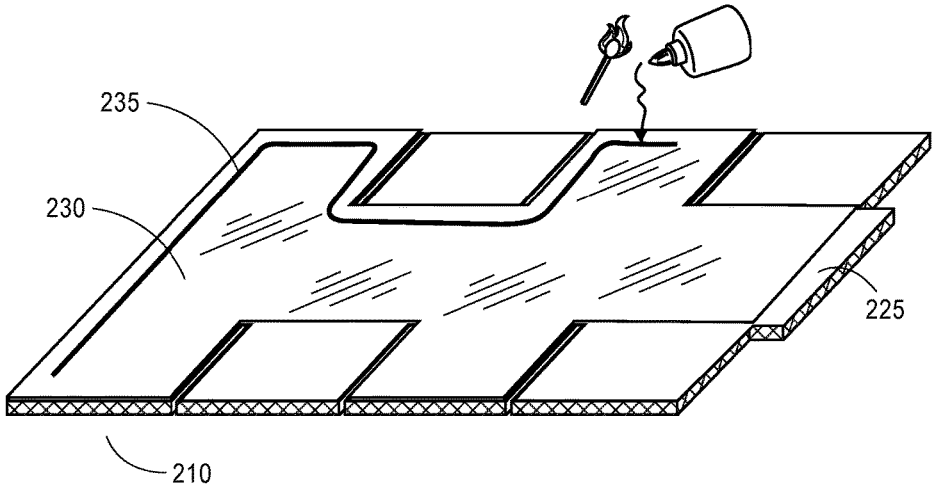

A flexible layer may be joined to a substrate to form all or a portion of an inflatable reservoir, by any system or method, and an inflatable reservoir may be formed between the flexible layer and the substrate, or between the flexible layer and another flexible layer. Referring to FIG. 2C, the first flexible layer 230 is sealed to an upper surface of the substrate 210 by heat-sealing, gluing or other sealing techniques. For example, where the first flexible layer 230 is a thin plastic sheet such as a polyethylene, and the substrate 210 is a corrugated fiberboard, the first flexible layer 230 may be glued and compressed into surfaces of the substrate 210 via one or more manual or automatic means. Where the first flexible layer 230 is a latex, a rubber or a nylon, and the substrate 210 is a thermoplastic material such as polycarbonate, the first flexible layer 230 may be melted or fused to the substrate 210 using one or more heated elements or heat sources. The first flexible layer 230 may be joined to the substrate 210 in a perimeter seal 235 that coincides with or otherwise nearly tracks edges of the substrate 210 and one or more of the crenels 228. Any portions of the first flexible layer 230 may be joined to any portions of the substrate 210, by any means, in accordance with the present disclosure.

Figure 2D:
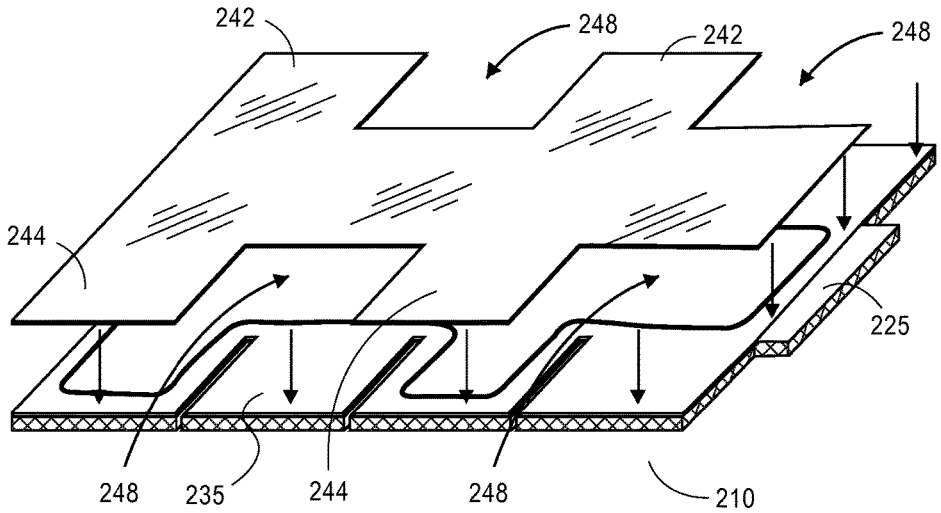
Figure 2E:
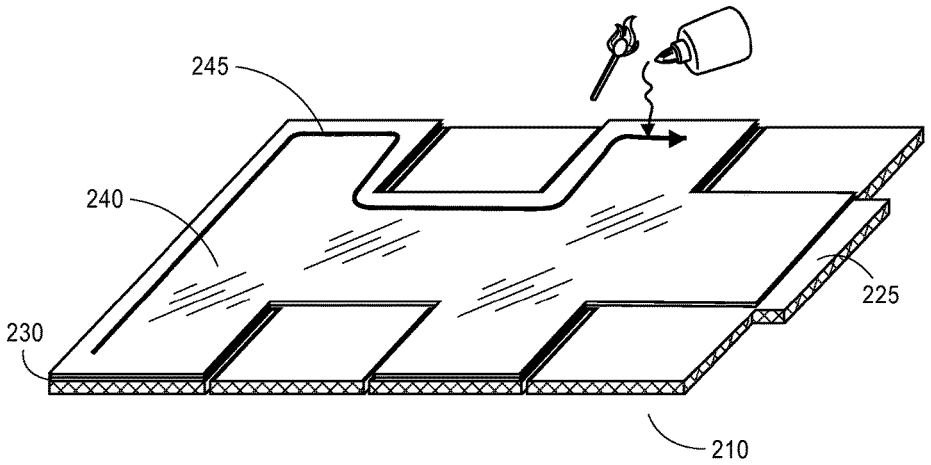

As is discussed above, an inflatable reservoir may be defined on a container blank of the present disclosure by a flexible volume provided between a substrate and a flexible layer that is joined to the substrate, or between two flexible layers, at least one of which may be joined to the substrate. One or more of the flexible layers may be joined to the substrate at a single point, or at multiple points, e.g., in a continuous line, or in a shape or pattern formed by one or more lines or line segments. Referring to FIG. 2D, a second flexible layer 240 is applied atop the first flexible layer 230. The second flexible layer 240 may include or comprise the same material as the first flexible layer 230, or different materials, and may include the same or a similar area as the first flexible layer 230, or a different layer. For example, as is shown in FIG. 2D, the second flexible layer 240 has a shape and size corresponding to shapes and sizes of the first flexible layer 230 and the substrate 210, respectively, and including top panels 242 corresponding to the top panels 232 of the first flexible layer 230 and two of the top panels 222 of the substrate 210, and bottom panels 244 corresponding to the bottom panels 234 of the first flexible layer 230, as well as crenels 248 corresponding to the crenels 238 of the first flexible layer. Referring to FIG. 2E, the second flexible layer 240 may be sealed to the first flexible layer 230 and/or the substrate 210 by any means, e.g., by heat-sealing, gluing or other sealing techniques. As is shown in FIG. 2E, a perimeter seal 245 is shown as being applied around a perimeter of the second flexible layer 240. The perimeter seal 245 may correspond to, follow or be within a vicinity of the perimeter seal 235. The perimeter seal 245 thus defines an inflatable reservoir between the first flexible layer 230 and the second flexible layer 240.

Figure 2F:
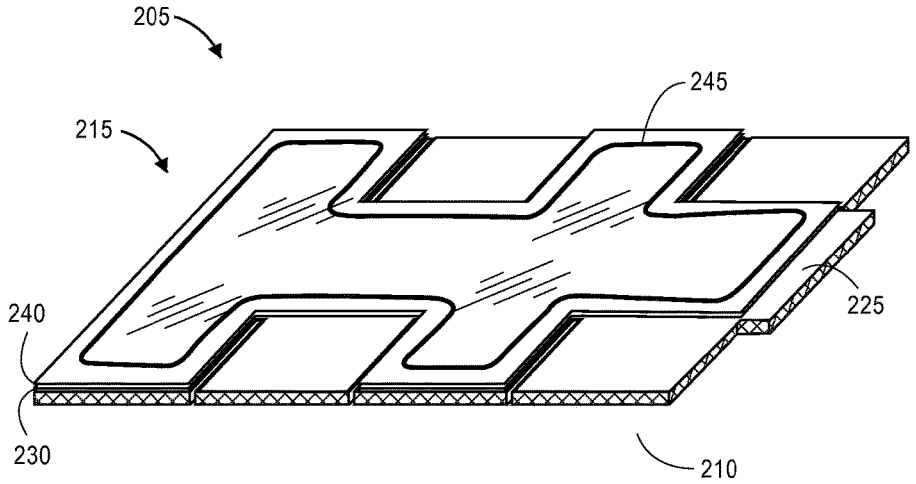

Upon sealing the one or more flexible layers defining an inflatable reservoir to one or more surfaces of a substrate shaped for forming a predetermined container, a container blank may be deemed complete. Referring to FIG. 2F, the container blank 205 is shown, with the first flexible layer 230 and the second flexible layer 240 joined to the substrate 210.

Those of ordinary skill in the pertinent arts will recognize that container blanks may be formed, and that one or more flexible layers may be applied to substrates for the purpose of forming a container blank, in any manner. For example, although the container blank 205 is shown as including both the first flexible layer 230 and the second flexible layer 240, container blanks may be formed with just a single flexible layer, thereby defining an inflatable reservoir between the flexible layer and one or more internal surfaces of a substrate. Alternatively, although the container blank 205 is shown as being formed with the first flexible layer 230 and the second flexible layer 240 applied to the substrate 210 independently and in series, those of ordinary skill in the pertinent arts will further recognize that two or more flexible layers may be applied to a substrate concurrently, or sealed to a substrate collectively, in accordance with the present disclosure.

Figure 3A:
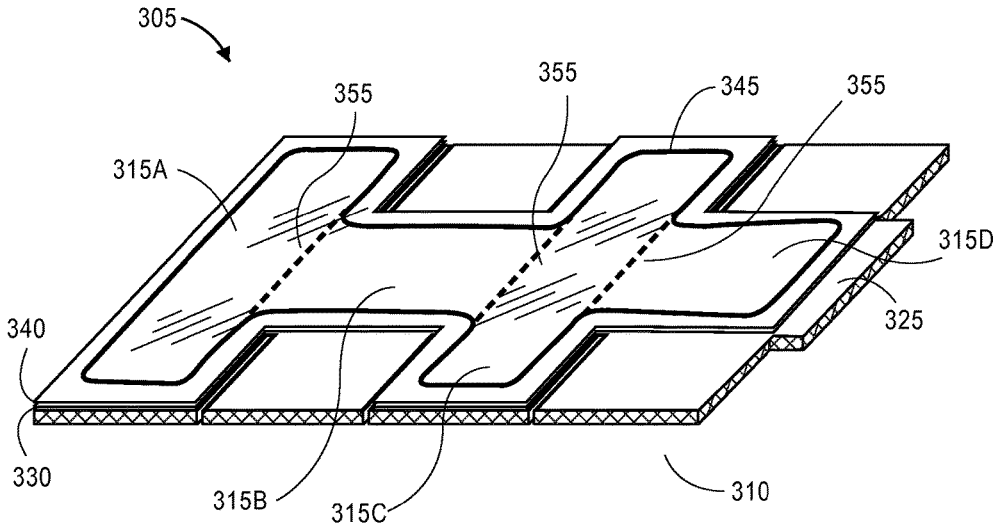
FIGS. 3A and 3B are views of aspects of container blanks for forming air-padded containers in accordance with embodiments of the present disclosure.
Figure 3B:
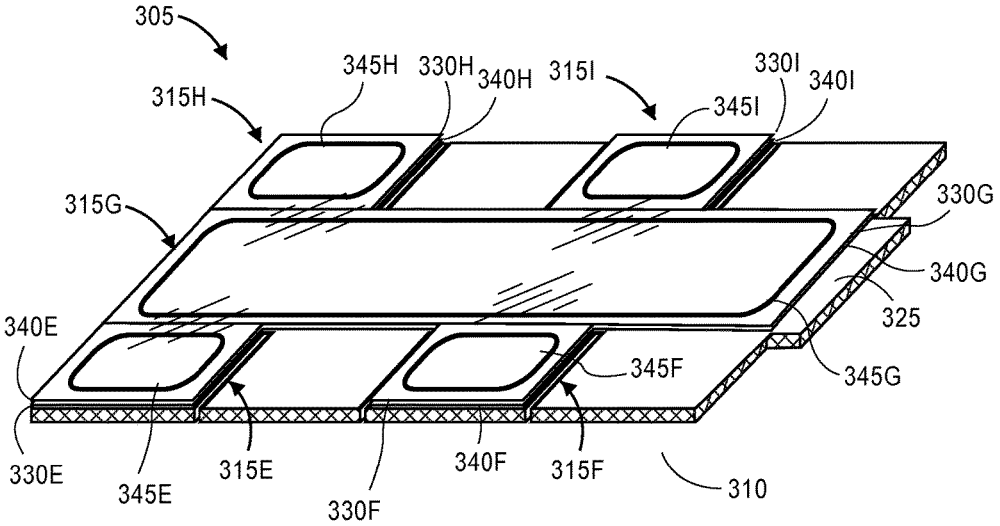

The inflatable reservoirs may be provided on container blanks, and within containers formed from such blanks, in any alignment, orientation or configuration in accordance with the present disclosure. Referring to FIGS. 3A and 3B, aspects of container blanks 305 for forming air-padded containers in accordance with embodiments of the present disclosure are shown. Except where otherwise noted, reference numerals preceded by the number "3" shown in FIGS. 3A and 3B indicate components or features that are similar to components or features having reference numerals preceded by the number "2" shown in FIGS. 2A through 2F or by the number "1" shown in FIGS. 1A through 1E.

As is shown in FIG. 3A, the container blank 305 includes a substrate 310 having a first flexible layer 330 and a second flexible layer 340 provided thereon. The container blank 305 of FIG. 3A is thus similar to the container blank 205 of FIG. 3F in that the second flexible layer 340 is joined to the first flexible layer 330 by a perimeter seal 345 about a perimeter of portions of the substrate 310, forming an inflatable volume between the first flexible layer 330 and the second flexible layer 340. Unlike the container blank 205 of FIG. 2F, however, the container blank 305 of FIG. 3A includes intermediate (or partial) seals 355 crossing the second flexible seal 340 as chords or other extensions between points on the perimeter seal 345. The intermediate seals 355 are provided to subdivide the inflatable volume between the first flexible layer 330 and the second flexible layer 340 into inflatable reservoirs 315A, 315B, 315C, 315D that are in fluid communication with one another, thereby enhancing the structural integrity of the inflatable reservoirs 315A, 315B, 315C, 315D when the container blank 305 is formed into a container. For example, the intermediate seals 355 may be applied to seal the first flexible layer 330 to the second flexible layer 340, or to seal the first flexible layer 330 and the second flexible layer 340 to the substrate 310, along one or more scores extending between panels of the substrate 310, e.g., along scores 226 extending between the side panels 220 of the substrate 210 of FIG. 2A.

Because the intermediate seals 355 do not isolate any portion of the inflatable volume between the first flexible layer 330 and the second flexible layer 340, and because the inflatable reservoirs 315A, 315B, 315C, 315D are in fluid communication with one another, only a single charging valve (not shown) may be required in order to inflate each of the inflatable reservoirs 315A, 315B, 315C, 315D when the container blank 305 is formed into a container and an items is sealed therein. Alternatively, those of ordinary skill in the pertinent arts will recognize that a container blank may include a plurality of independent and fluidly isolated inflatable reservoirs that are discretely provided on one or more panels of the container blank.

As is shown in FIG. 3B, the container blank 305 includes a substrate 310 having a plurality of lower flexible layers 330E, 330F, 330G, 330H, 330I and upper flexible layers 340E, 340F, 340G, 340H, 340I provided thereon. Each of the upper flexible layers 340E, 340F, 340G, 340H, 340I is joined to each of the lower flexible layers 330E, 330F, 330G, 330H, 330I via a perimeter seal 345E, 345F, 345G, 345H, 345I, which define independent and fluidly isolated inflatable reservoirs 315E, 315F, 315G, 315H, 315I that are formed on surfaces of the substrate 310. For example, as is shown in FIG. 3B, the inflatable reservoirs 315E, 315F are formed on bottom panels of the substrate 310, e.g., the bottom panels 224 of the substrate 210 of FIG. 2A, while the inflatable reservoirs 315H, 315I are formed on top panels of the substrate 310, e.g., the top panels 222 of the substrate 210 of FIG. 2A. Additionally, the inflatable reservoir 315G is formed on multiple side panels of the substrate 310, e.g., the side panels 226 of the substrate 210 of FIG. 2A. Thus, when the container blank 305 of FIG. 3B is formed into a container, and one or more items are sealed within the container, at least five charging valves (not shown) will be required in order to inflate each of the inflatable reservoirs 315E, 315F, 315G, 315H, 315I.

Those of ordinary skill in the pertinent arts will recognize that, in addition to the container blanks 205, 305 of FIG. 2F, 3A or 3B, container blanks may be formed with multiple inflatable reservoirs in any orientation or configuration, and that such reservoirs may be provided on one or more of the panels of a substrate, in any size, number or shape in accordance with the present disclosure.

Alternatively, referring again to the container blank 205 shown in FIG. 2F, multiple inflatable reservoirs may be formed between the first flexible layer 230 and the second flexible layer 240 by providing an intermediate seal in a manner similar to the perimeter seal 235 or the perimeter seal 245 in locations other than a perimeter of the substrate 210, the first flexible layer 230 or the second flexible layer 240. For example, by providing an intermediate seal that extends across the second flexible layer 240 of the container blank 205 between one portion of the perimeter seal 245 and another portion of the perimeter seal 245 may divide the inflatable reservoir formed between the first flexible layer 230 and the second flexible layer 240 into two discrete inflatable reservoirs.

Moreover, when a container is formed from a container blank having a plurality of inflatable reservoirs, each of the inflatable reservoirs may be charged with air or other fluids via a single valve extending through a hole in a substrate defining a flow path into one or more of the inflatable reservoirs, which may be in fluid communication with one another. Alternatively, two or more of the inflatable reservoirs may be charged with air or other fluids via dedicated valves extending through holes in the substrate, each defining flow paths to the two or more of the inflatable reservoirs, which may be in fluid isolation, and not in fluid communication, with one another.

Furthermore, although the inflatable reservoir is shown as being joined to substantially an entire surface of the substrate 210, those of ordinary skill in the pertinent arts will also recognize that inflatable reservoirs may be formed on portions of a surface of a substrate, e.g., in one or more discrete points, or on fewer than all of the side panels 220, the top panels 222 or the bottom panels 224, in accordance with the present disclosure.

Figure 4A:
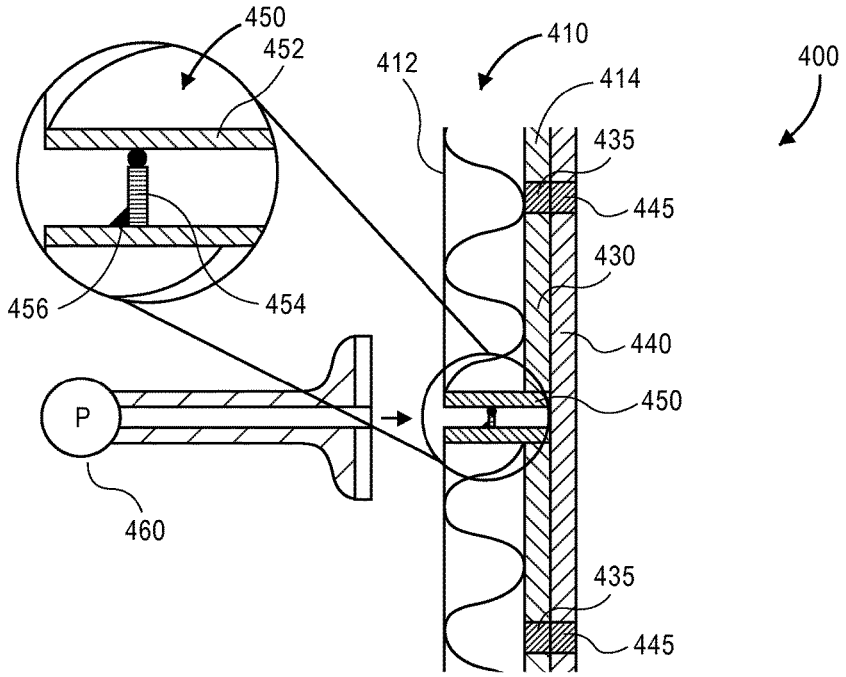
FIGS. 4A through 4C are views of aspects of one air-padded container in accordance with embodiments of the present disclosure.
Figure 4B:
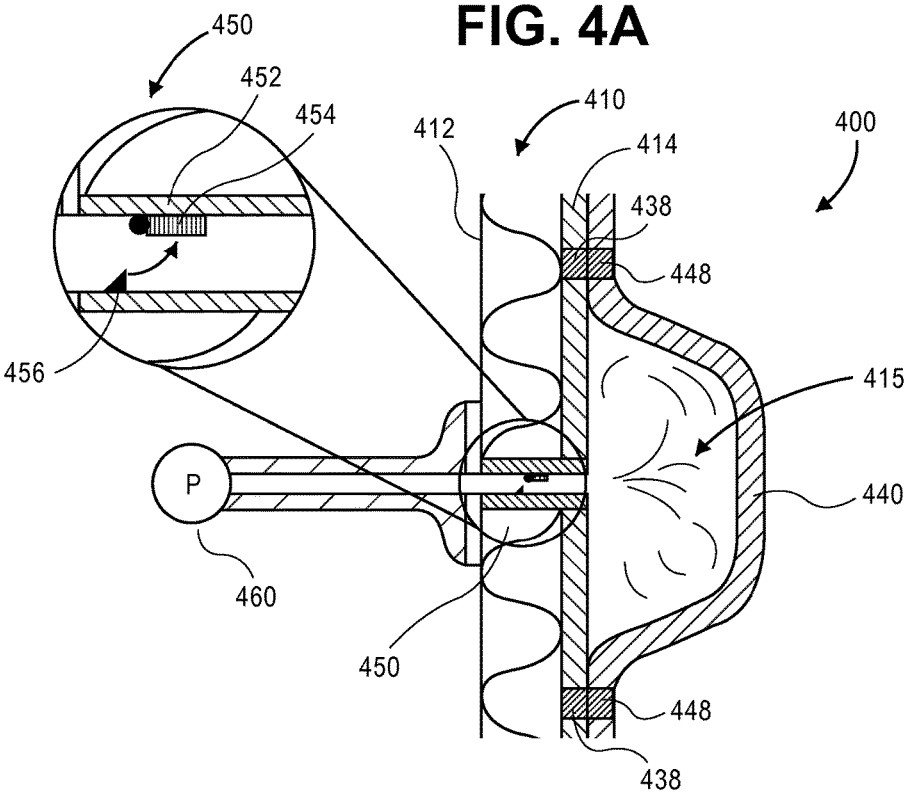
Figure 4C:
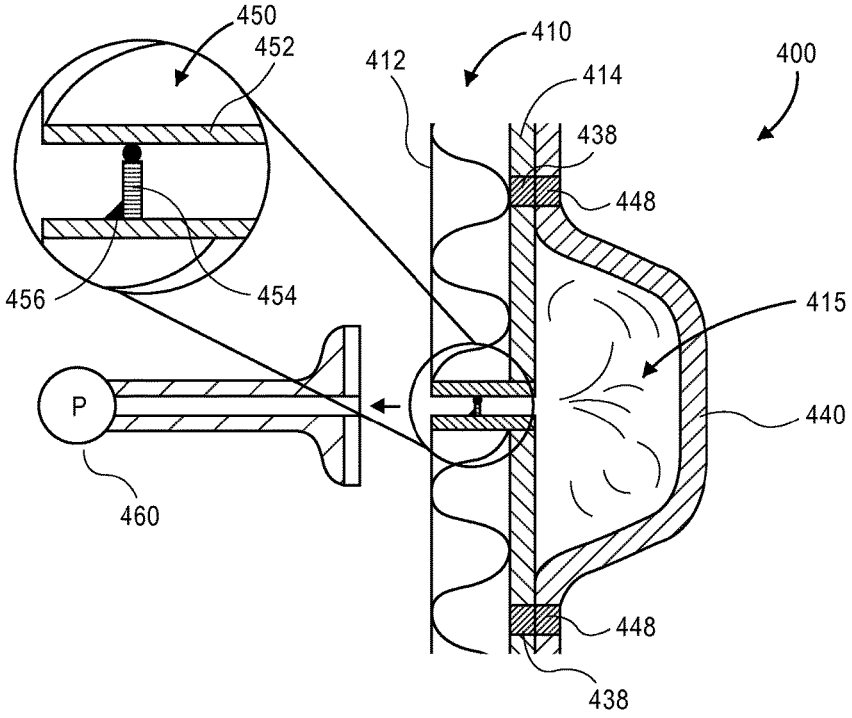

As a container blank is being prepared, or after a container blank has been folded, rolled or otherwise shaped or assembled into a container, an inflating valve may be installed therein. Such inflating valves may be provided to charge air from an external surface of a container and define a flow path into an inflatable reservoir within the container in a first direction, but may resist the flow from the inflatable reservoir outside of the container in a second direction. Referring to FIGS. 4A through 4C, views of aspects of one air-padded container 300 in accordance with embodiments of the present disclosure are shown. Except where otherwise noted, reference numerals preceded by the number "4" shown in FIGS. 4A through 4C indicate components or features that are similar to components or features having reference numerals preceded by the number "3" shown in FIGS. 3A and 3B, by the number "2" shown in FIGS. 2A through 2F or by the number "1" shown in FIGS. 1A through 1E.

As is shown in FIG. 4A, a cross-sectional view of a portion of the container 400 includes a portion of a substrate 410, a first flexible layer 430, a second flexible layer 440, an inflating valve 450 and a pressure source 460. The substrate 410 includes an external surface 412 and an internal surface 414, and may be formed from any suitable materials, including one or more papers, cardboards, plastics, rubbers, woods or metals. The first flexible layer 430 and the second flexible layer 440 are joined to the internal surface 414 of the substrate 410 by seals 435, 445. The first flexible layer 430 and the second flexible layer 440 may be formed from any suitable flexible materials (e.g., polyethylenes) and the seals 435, 445 may seal the first flexible layer 430 and the second flexible layer 440 to one another, or to the substrate 410, in any manner.

Referring to FIG. 4A, the inflating valve 450 includes a tube 452, a gate 454 and a stopper 456. As is shown in FIG. 4A, the inflating valve 450 is provided in and aligned with a hole in the substrate 410 and includes an inlet on the external surface 412 of the substrate and an outlet entering the inflatable reservoir 415, thereby defining a flow path between the external surface 412 and the inflatable reservoir 415. In some implementations, the inflating valve 450 may be any type or form of valve, e.g., a check valve, that extends between the external surface 412 of the substrate and the inflatable reservoir 415 and allows flow in one direction, e.g., from an inlet provided outside of the external surface 412 through an outlet and into the inflatable reservoir 415, and not in a reverse direction. The gate 454 may be opened when pressure from the pressure source 460 exceeds pressure within the inflatable reservoir 415 defined between the first flexible layer 430 and the second flexible layer 440, and closed against the stopper 456 when pressure within the inflatable reservoir 415 exceeds pressure provided by the pressure source 460.

Referring to FIG. 4B, fluid pressure provided by the pressure source 460 causes the gate 454 to open, and allows air to pass from the pressure source 460 into the inflatable reservoir 415. The increasing pressure within the inflatable reservoir 415 causes the second flexible layer 440 to expand in volume from the inner surface 414 of the substrate 410 until the second flexible layer 440 comes into contact with an item (not shown) within the container 400. Referring to FIG. 4C, when fluid pressure within the inflatable reservoir 415 meets or exceeds a predetermined threshold limit, the charging of air into the inflatable reservoir 415 may be isolated, and the pressure source 460 may be removed therefrom, thereby causing the inflating valve 450 to close, with the charged air remaining within the inflatable reservoir 415.

Accordingly, when multiple surfaces of the inflatable reservoir 415 come into contact with the item, the item may be properly surrounded with dunnage within the container 400, e.g., suspended therein by custom-sized layers of dunnage that are light in weight and do not require any additional time or interaction by human or automated operators, other than to charge air into the inflating valve 450 from the pressure source 460 after the container 400 has been sealed. The pressure source 460 may be any manual or automated pressure charging system including but not limited to a compressor, a pump, or even a straw for receiving and charging air blown or otherwise exhaled by a human.

Figure 5A:
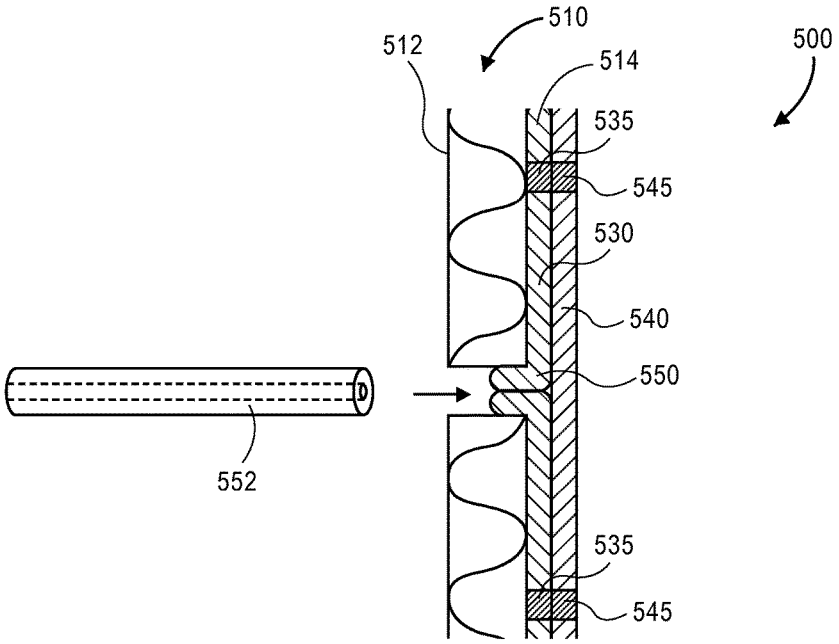
FIGS. 5A through 5C are views of aspects of one air-padded container in accordance with embodiments of the present disclosure.
Figure 5B:
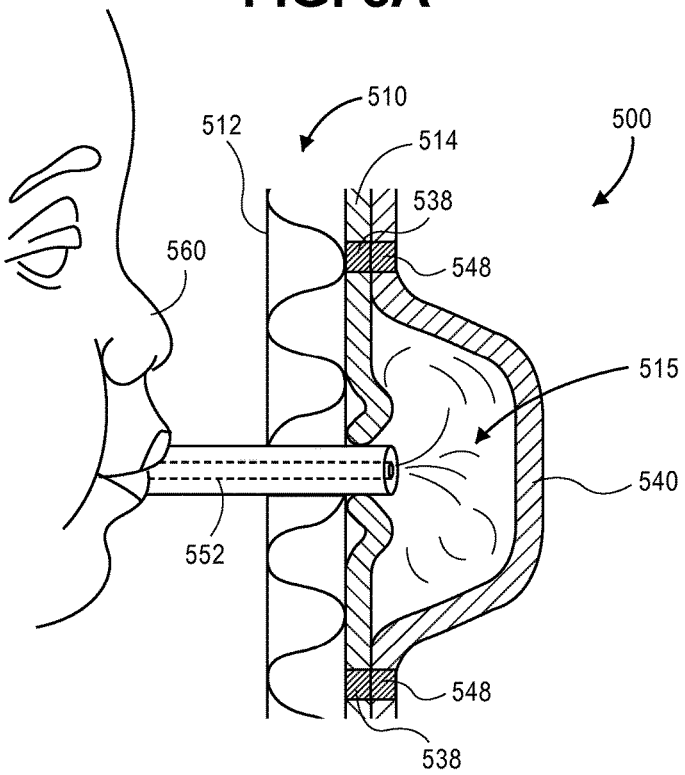
Figure 5C:
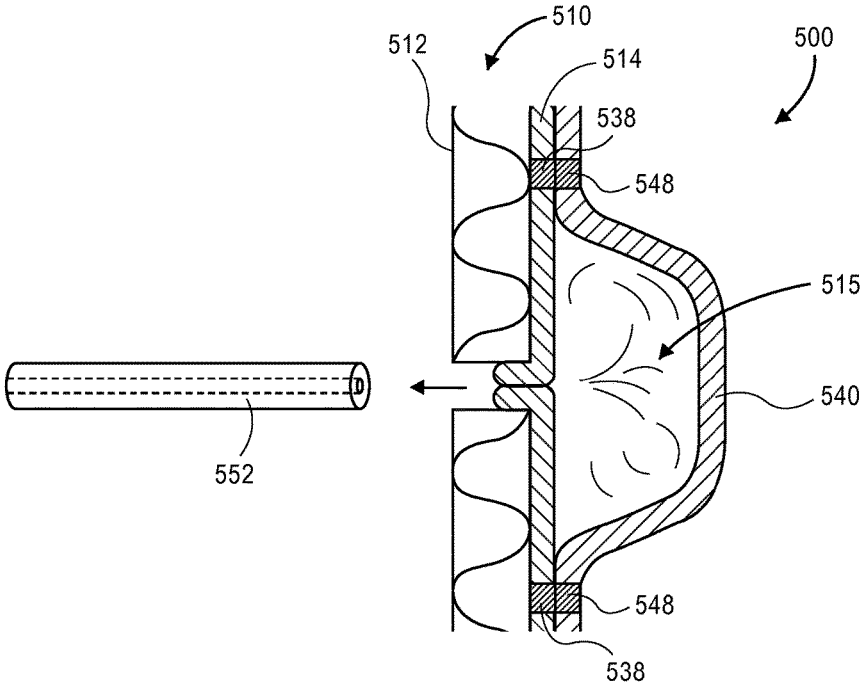

Referring to FIGS. 5A, 5B and 5C, views of aspects of one air-padded container 400 in accordance with embodiments of the present disclosure are shown. Except where otherwise noted, reference numerals preceded by the number "5" shown in FIGS. 5A through 5C indicate components or features that are similar to components or features having reference numerals preceded by the number "4" shown in FIGS. 4A through 4C, by the number "3" shown in FIG. 3A and FIG. 3B, by the number "2" shown in FIGS. 2A through 2F or by the number "1" shown in FIGS. 1A through 1E.

As is shown in FIGS. 5A, 5B and 5C, a cross-sectional view of a portion of the container 500 includes a portion of a substrate 510, a first flexible layer 530, a second flexible layer 540, an inflating valve 550 and a pressure source 560 (e.g., a breathing human). The substrate 510 includes an external surface 512 and an internal surface 514, and may be formed from any suitable materials, including one or more papers, cardboards, plastics, rubbers, woods or metals. The first flexible layer 530 and the second flexible layer 540 are joined to the internal surface 514 of the substrate 510 by seals 535, 545.

Referring to FIG. 5A, the inflating valve 550 is formed within the container 500 by portions of the first flexible layer 530 and is configured to receive a tube (e.g., a straw) 552 therein. As is shown in FIG. 5A, the inflating valve 550 is aligned with a hole in the substrate 510, and is formed from surfaces of the first flexible layer 530 that may be gathered, puckered or otherwise contracted about a self-sealing perforation in the first flexible layer 530. The inflating valve 550 may be configured to open upon receiving an insertion of the tube 552 defines a flow path in one direction, e.g., from an inlet aligned with the hole in the substrate in fluid connection with an exterior of the external surface 514 through an outlet into the inflatable reservoir 515, when pressure at the pressure source 560, e.g., within a mouth of the breathing human, exceeds a pressure within the inflatable reservoir 515. The inflating valve 550 may be configured to close when the tube 552 is withdrawn therefrom, and to inhibit flow in a reverse direction, e.g., from within the inflatable reservoir 515 to outside of the external surface 514.

Referring to FIG. 5B, fluid pressure provided by the pressure source 560 allows air to pass from the pressure source 560 into the inflatable reservoir 515 through the inflating valve 550 via the tube 552, thereby increasing pressure within the inflatable reservoir 515 and causing the second flexible layer 540 to expand in volume from the inner surface 514 of the substrate 510 until the second flexible layer 540 comes into contact with an item (not shown) within the container 500. Referring to FIG. 5C, when fluid pressure within the inflatable reservoir 515 meets or exceeds a predetermined threshold limit, the tube 552 may be withdrawn therefrom, thereby causing the inflating valve 550 to close, with the charged air remaining within the inflatable reservoir 515.

As is discussed above, the pressure inflatable reservoirs within air-padded containers of the present disclosure may be charged with air from any external source, and the pressure within the inflatable reservoirs may be regulated or monitored during charging using one or more regulators, sensors, gauges or meters. If the pressure exceeds a predetermined threshold, the charging may be manually or automatically secured in order to avoid bursting one or more aspects of the inflatable reservoirs, or increasing a risk of damage to any items therein. Such monitoring, regulation and/or control is particularly valuable where the air-padded container is sealed with one or more items therein, and one or more flexible layers may not be visually monitored during a charging process.

Figure 6:
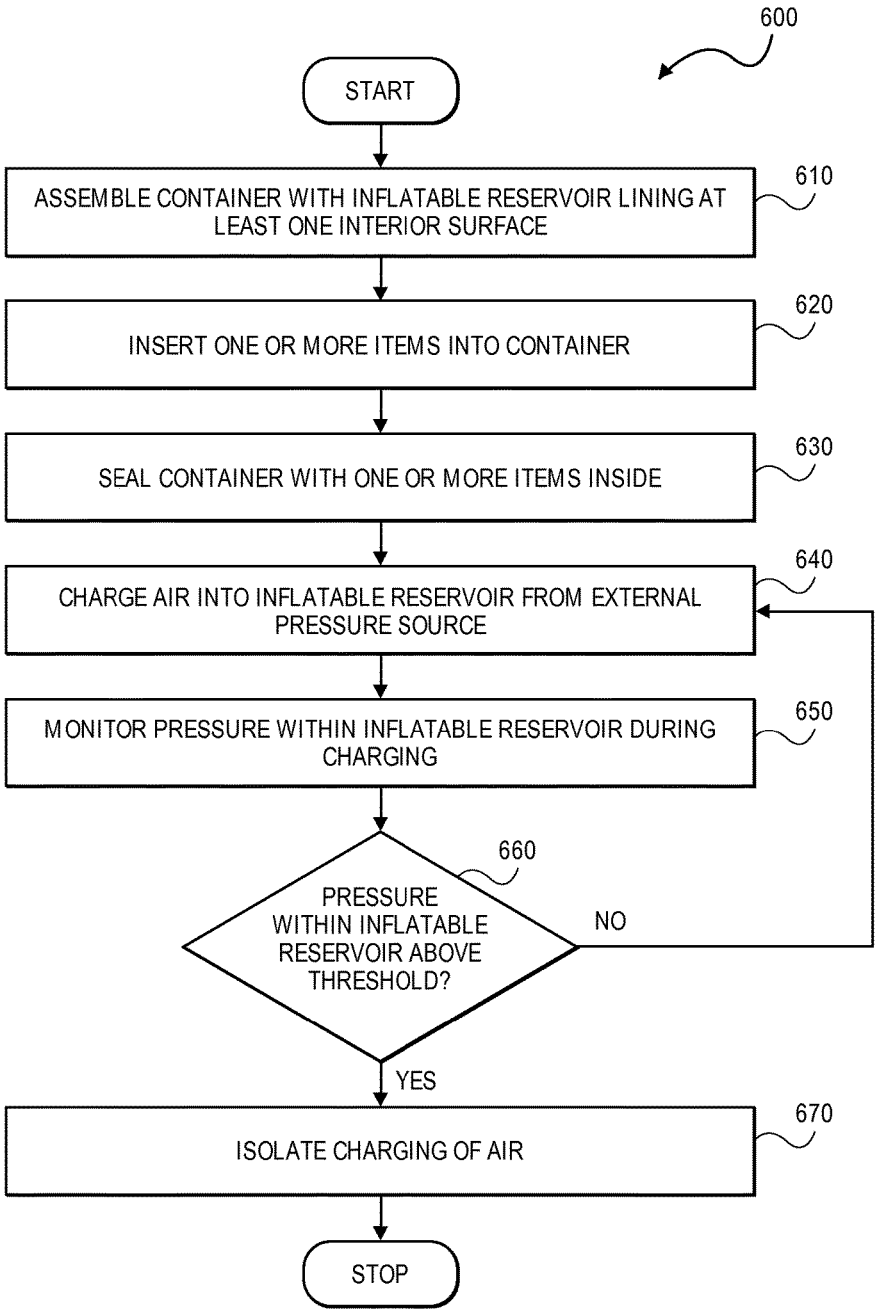
FIG. 6 is a flow chart of one process for preparing an item for delivery in an air-padded container in accordance with embodiments of the present disclosure.

Referring to FIG. 6, a flow chart 600 representing one process for preparing an item for delivery in an air-padded container in accordance with embodiments of the present disclosure is shown. At box 610, a container with an inflatable reservoir lining at least one interior surface thereof is assembled. For example, the container may be formed from a container blank having an inflatable reservoir formed from one or more flexible layers, such as the container blank 205 of FIG. 2F, by folding or rolling the various faces of the container into a predetermined shape and sealing one or more edges of the container blank using an adhesive or binder. At box 620, one or more items may be inserted into the formed container, and at box 630 the container is sealed with the one or more items inside. For example, referring again to FIGS. 1A through 1C, items may be inserted into an air-lined container 100 and enclosed therein by folding one or more flaps or crenellations and sealing such flaps or crenellations with adhesives, elastics, straps, staples, bands or other like substances or components.

At box 640, air is charged into the inflatable reservoir from an external pressure source, e.g., compressors such as axial-flow compressors, centrifugal compressors or reciprocating compressors, a manual or automatic pump (e.g., a bicycle pump), or a mouth-blown straw or other oral inflation device. At box 650, the pressure within the inflatable reservoir is monitored during charging. For example, a pressure regulator, sensor, gauge or meter may be provided in association with a pump or compressor, or along a charging line leading to the container, and a pressure within the inflatable reservoir (e.g., an absolute pressure or a gage pressure) may be manually or automatically monitored during the charging by one or more human operators or automated agents.

At box 660, whether the pressure within the inflatable reservoir meets or exceeds a predetermined threshold is determined. The pressure within the inflatable reservoir may be continuously monitored, or monitored at discrete intervals of time, and compared against a preset threshold that may be selected based at least in part on attributes of the container (e.g., dimensions, surface areas, densities or materials of the substrate or any flexible layers) or the item (e.g., intrinsic properties such as volumes, surface areas, masses, weight distributions or surface qualities, as well as intended destinations, modes of transit or durations of transit for the item), or on any other basis. If the pressure within the inflatable reservoir does not exceed the predetermined threshold, then the process returns to box 640, where air continues to be charged into the inflatable reservoir from the external pressure source. When the pressure exceeds the predetermined threshold, however, the filling of the air may be halted, and the container may be shipped with the items therein to an intended destination. Those of ordinary skill in the pertinent arts will recognize that the charging of air into implementations of the inflatable reservoirs of an air-padded container disclosed herein may be defined with regard to variables or attributes other than pressure within the inflatable reservoirs. For example, charging may begin and end at predetermined times or be limited to predetermined intervals of time. Likewise, charging may be defined with respect to a given volume or mass of air, rather than a time of charging or a pressure within the inflatable reservoirs.

Figure 7A:
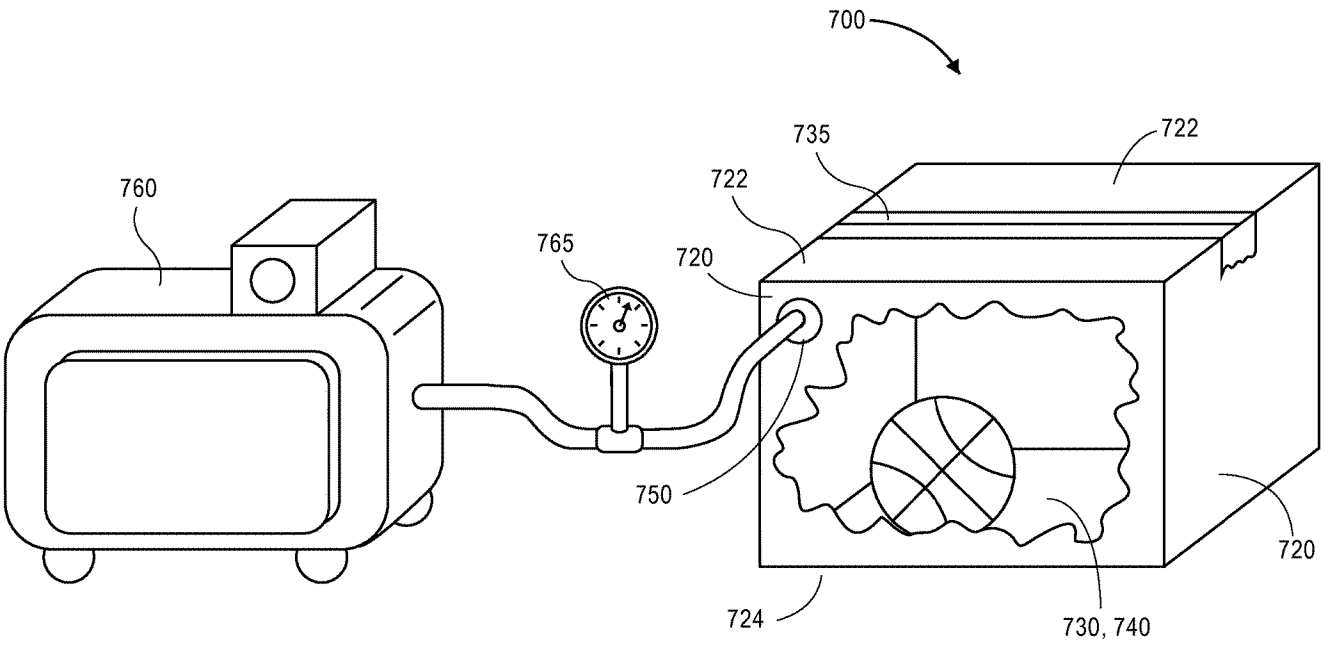
FIGS. 7A and 7B are views of information regarding the preparation of an item for delivery in an air-padded container in accordance with embodiments of the present disclosure.
Figure 7B:
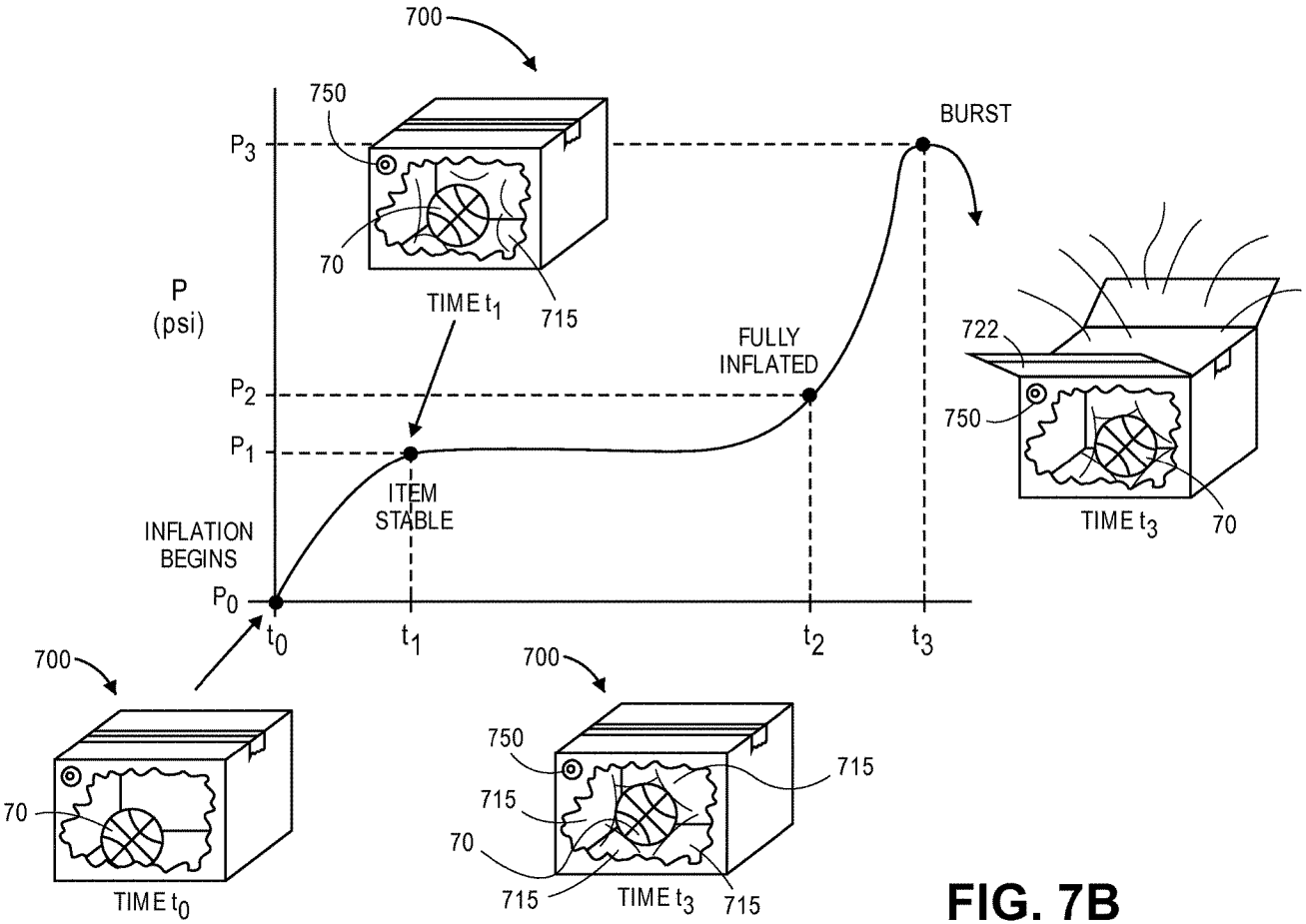

The monitoring of the pressure within an inflatable reservoir according to some implementations of the present disclosure is shown with regard to FIGS. 7A and 7B. Referring to FIGS. 7A and 7B, views of information regarding the preparation of an item for delivery in an air-padded container 700 in accordance with embodiments of the present disclosure are shown. Except where otherwise noted, reference numerals preceded by the number "7" shown in FIGS. 7A and 7B indicate components or features that are similar to components or features having reference numerals preceded by the number "5" shown in FIGS. 5A through 5C, by the number "4" shown in FIGS. 4A through 4C, by the number "3" shown in FIGS. 3A and 3B, by the number "2" shown in FIGS. 2A through 2F or by the number "1" shown in FIGS. 1A through 1E.

As is shown in FIG. 7A, an item 70 is sealed within the container 700, which is formed from a plurality of side panels 720, top panels 722 and bottom panels 724, and lined by a plurality of flexible layers 730, 740. The container 700 is sealed with the item 70 therein using an adhesive tape 735, and a pressure source 760 (e.g., a compressor) is aligned to charge air into an inflatable reservoir 715 defined by the plurality of flexible layers 730, 740 via a charging valve 750. A pressure gauge 765 is aligned along a charging connection between the pressure source 760 and the container 700.

As is shown in FIG. 7B, a plot of the pressure indicated by the pressure gauge 765 over time is shown. At time $t_0$, inflation begins, and with no difference between atmospheric pressure and the pressure within the inflatable reservoir 715. At time $t_1$, after an initial volume of air has been charged into the inflatable reservoir 715, and the pressure within the inflatable reservoir 715 is steady, the item 70 is stabilized on one or more surfaces of the flexible layers 730, 740 as air continues to be charged into the inflatable reservoir 715.

At time $t_2$, with the item 70 fully suspended within the container 700, pressure begins to climb when the inflatable reservoir 715 has little to no further room to expand. As is shown in the plot, the pressure reaches an inflection point and rapidly increases as air continues to be charged into the inflatable reservoir 715. At time $t_3$, a burst pressure of the inflatable reservoir 715 is reached, and the item 70 is no longer safely suspended within the container 700 after the inflatable reservoir 715 and/or the container 700 have burst.

Accordingly, in some implementations of the present disclosure, the pressure within an inflatable reservoir provided within an air-padded container may be monitored during the charging of air therein, and may be secured when the pressure meets or exceeds a pressure threshold associated with the inflatable reservoir, the container or the item therein. The pressure threshold may be set by any relevant entity and on any basis. For example, the pressure threshold may be defined by a manufacturer of a container and/or inflatable reservoir therein. The pressure threshold may also be determined based on historical observations regarding the inflation of the inflatable bladder or the container. The pressure threshold may be further determined based on historical observations regarding the inflation of containers including the item, one or more attributes of the item (e.g., attributes, features, configurations or shapes). Because the inflatable reservoir may not be visually evaluated during the charging after the container has been sealed, monitoring the pressure of the inflatable reservoir using one or more regulators, sensors, gauges or meters may ensure that items within the container are properly protected and that the inflatable reservoir does not rupture during the inflation process. If the inflatable reservoir does rupture, however, the container may be reopened and subject to visual evaluation or further considerations, such as whether the items therein should be packed into a different container, or whether the item may remain within its original container and packed with one or more traditional forms of dunnage.

The air-padded containers of the present disclosure are not limited to boxes of rectangular or standard shapes. Referring to FIGS. 8A through 8E, views of aspects of one air-padded container 800 (e.g., a cylindrical shipping tube) in accordance with embodiments of the present disclosure are shown. Except where otherwise noted, reference numerals preceded by the number "8" shown in FIGS. 8A through 8E indicate components or features that are similar to components or features having reference numerals preceded by the number "7" shown in FIGS. 7A and 7B, by the number "5" shown in FIGS. 5A, 5B and 5C, by the number "4" shown in FIGS. 4A through 4C, by the number "3" shown in FIGS. 3A and 3B, by the number "2" shown in FIGS. 2A through 2F or by the number "1" shown in FIGS. 1A through 1E.

Figure 8B:
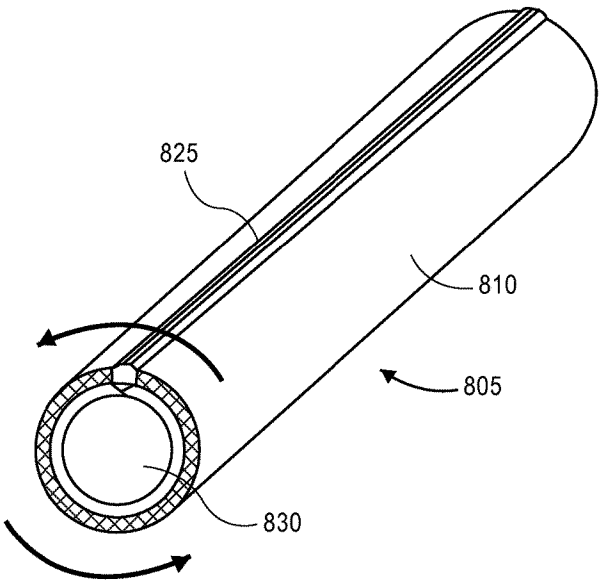
FIGS. 8A through 8E are views of aspects of one air-padded container in accordance with embodiments of the present disclosure.
Figure 8A:
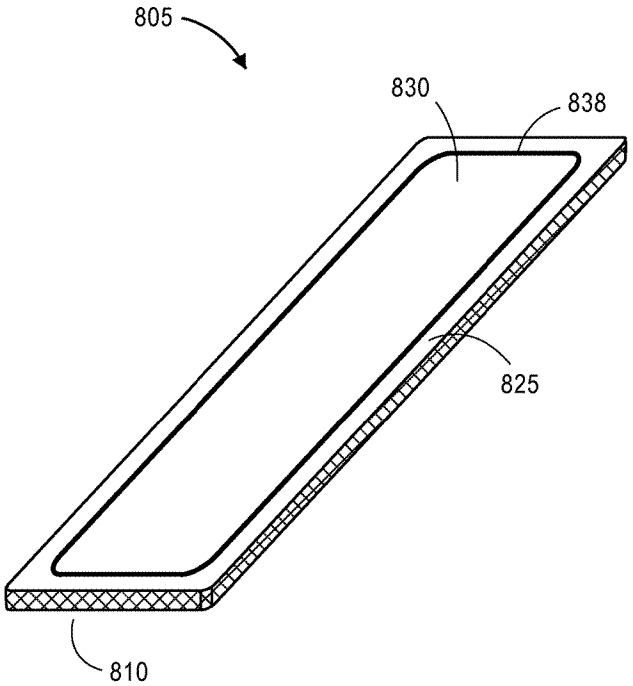

Referring to FIG. 8A, a container blank 805 formed from a substrate 810 and a flexible layer 830 is shown. The substrate 810 includes a sealing edge 825. The flexible layer 830 is sealed to the substrate by a perimeter seal 835. Referring to FIG. 8B, the container blank 805 of FIG. 8A may be rolled in a substantially circular fashion to form a cylindrical hollow, and the sealing edge 825 may be joined to another edge or other surface of the container blank 805, e.g., using one or more adhesives or joining components.

Figure 8C:
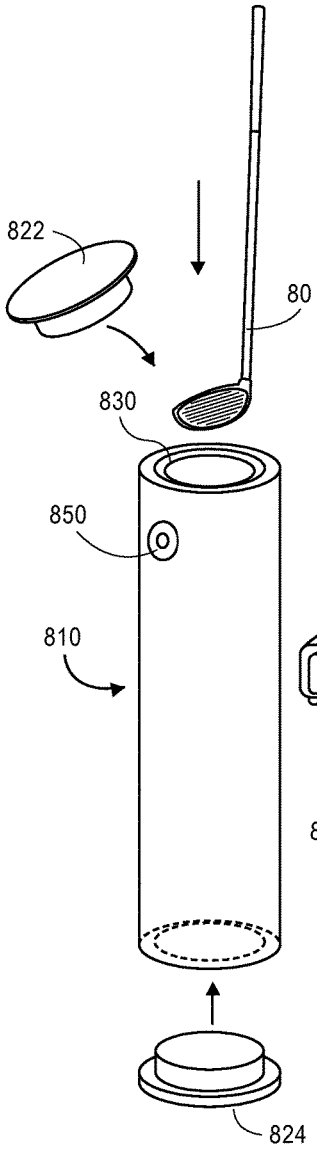
Figure 8D:
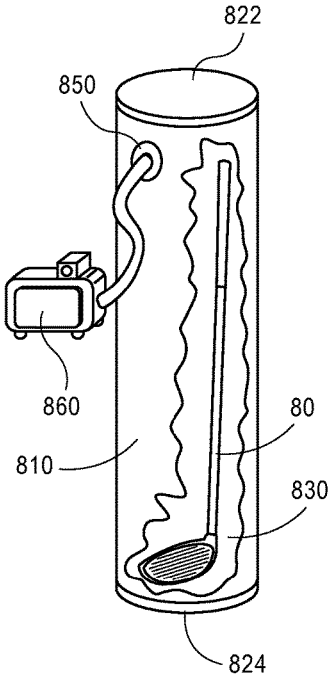
Figure 8E:
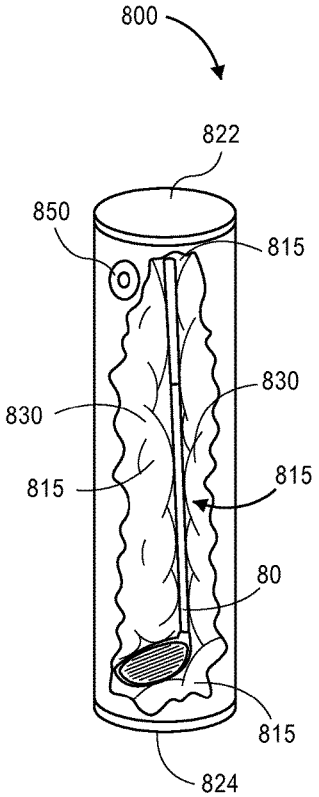

Referring to FIG. 8C, an item 80 (viz., a golf club) is inserted into the rolled container blank 805 and sealed therein by a top cap 822 and a bottom cap 824, thereby defining the container 800. The top cap 822 and/or the bottom cap 824 may be joined to the rolled container blank 805 by any features or techniques, e.g., adhesives such as shipping tapes or glues, or by mechanical methods such as screwing, binding or crimping. Referring to FIG. 8D, after the item 80 has been sealed into the container 800, air may be charged into an air reservoir 815 defined between the flexible layer 830 and an interior surface of the container 800 via a charging valve 850 using an air compressor 860 or other pressure source. Referring to FIG. 8E, after sufficient volumes of air are charged into the air reservoir 815, the item 80 is properly suspended within the container 800 by contact with the flexible layer 830. The container 800 may then be delivered to a destination, with the item 80 suspended therein, by mail, common carrier or any other delivery means or transit modes, e.g., automobiles, aircraft or watercraft.

Those of ordinary skill in the pertinent arts will recognize that the air-padded containers of the present disclosure, including but not limited to the container 800 of FIGS. 8A through 8E, may be provided with two or more inflatable reservoirs provided along interior surfaces thereof. For example, referring again to FIG. 8C, the top cap 822 and the bottom cap 824 may also be provided with one or more inflatable reservoirs which, when inflated, provide protection to the item 80 in axial directions, e.g., in a top direction and in a bottom direction, thereby complementing the protection provided to the item 80 in a circumferential direction by the air reservoir 815.

Figure 9B:
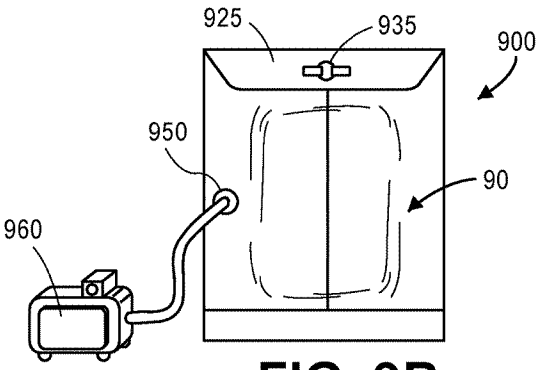
FIGS. 9A through 9C are views of aspects of one air-padded container in accordance with embodiments of the present disclosure.
Figure 9C:
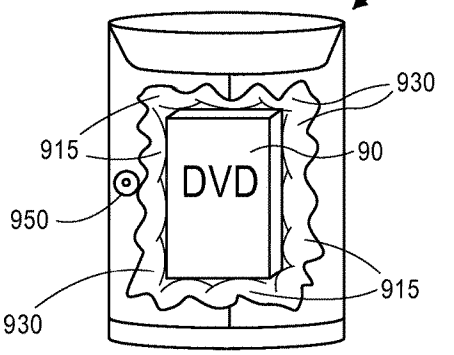
Figure 9A:
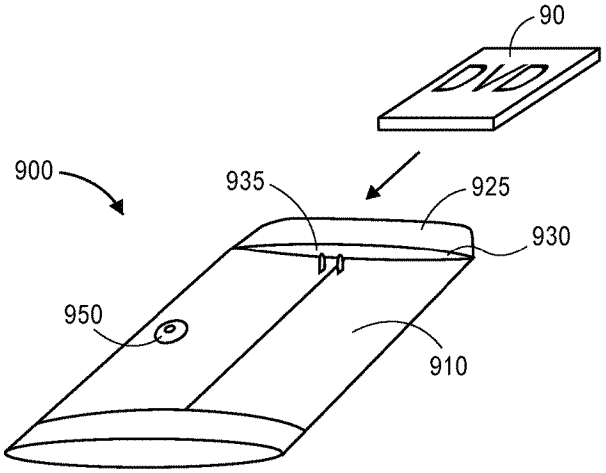

As is also discussed above, the air-padded containers of the present disclosure need not be formed from cardboard or other rigid surfaces. Referring to FIGS. 9A through 9C, views of aspects of one air-padded container 900 in accordance with the present disclosure are shown. Except where otherwise noted, reference numerals preceded by the number "9" shown in FIGS. 9A through 9C indicate components or features that are similar to components or features having reference numerals preceded by the number "8" shown in FIGS. 8A through 8E, by the number "7" shown in FIGS. 7A and 7B, by the number "5" shown in FIGS. 5A through 5C, by the number "4" shown in FIGS. 4A through 4C, by the number "3" shown in FIGS. 3A and 3B, by the number "2" shown in FIGS. 2A through 2F or by the number "1" shown in FIGS. 1A through 1E.

As is shown in FIGS. 9A through 9C, the container 900 is an envelope formed from a substrate 910 of Manila paper, oak tag or other like paper-fiber or cellulosic materials, or from one or more flexible plastic or rubber materials (e.g., polyethylenes). For example, the substrate 910 may include a main panel, a plurality of flaps (e.g., a bottom flap, a left side flap and a right side flap), scores provided on edges extending between the main panel and each of the flaps, a sealing edge and a score between the main panel and the sealing edge. Those of ordinary skill in the pertinent arts will recognize that the container 900 may be formed from the substrate 910 by folding the substrate 910 about a first score between a main panel and a bottom flap, a second score between the main panel and a left side flap and a third score between the main panel and a right side flap, and sealing the flaps to one another to form a void or cavity therein. Subsequently, an item may be inserted within the container 900, and the item may be sealed therein by folding the sealing edge about a fourth score between the main panel and the sealing edge, and joining the sealing edge to one or more of the bottom flap, the left side flap or the right side flap.

As is shown in FIGS. 9A and 9B, the container 900 includes a sealing edge 925 and is lined with one or more flexible layers 930 along an interior surface of the container 900. Additionally, the container 900 further includes a clasp 935 and an inflating valve 950 extending from an exterior of the container 900 to an interior of the container 900. When the container 900 is opened, an item 90 (e.g., an optical disc such as a compact disc, a digital versatile disc or other form of media stored on a polycarbonate plastic or other plastic and wrapped in an appropriate package) may be inserted therein.

As is shown in FIG. 9B and FIG. 9C, when the item 90 is sealed within the container 900 by folding the sealing edge 925 over and closing the container 900 with the clasp 935, a pressure source 960 (e.g., a compressor) may be aligned to charge air or another suitable fluid into an inflatable reservoir 915 defined between the one or more flexible layers 930 and an interior surface of the container 900 via the inflating valve 950. As the inflatable reservoir 915 fills with air, the container 900 expands to accommodate the increasing volume of the inflatable reservoir 915, which forms a barrier around the item 90 within the container 900. When the pressure within the inflatable reservoir 915 reaches a predetermined threshold or desired level, the charging may be secured, and the pressure source 960 may be removed from the inflating valve 950. The container 900 may thus be mailed, shipped or otherwise delivered to a destination, with the item 90 shielded by the inflatable reservoir 915 therein.

Therefore, unlike traditional padded envelopes, which are lined with soft materials such as foam, the container 900 may provide a lightweight and suitable protective layer of dunnage for items, such as the item 90, by inflating the inflatable bladder 915 with air or another fluid with the items sealed therein. Unlike padded envelopes that are lined with a plurality of air pockets or volumes, e.g., "bubble wrap," the container 900 will be filled with a customized volume of air corresponding to the aggregate volume of the items sealed therein. Therefore, once the container 900 has been sealed and the inflatable bladder 915 has been inflated to a predetermined pressure, the container 900 may define a consistent exterior shape and volume regardless of the number, type or size of the items sealed therein.

Figure 10B:
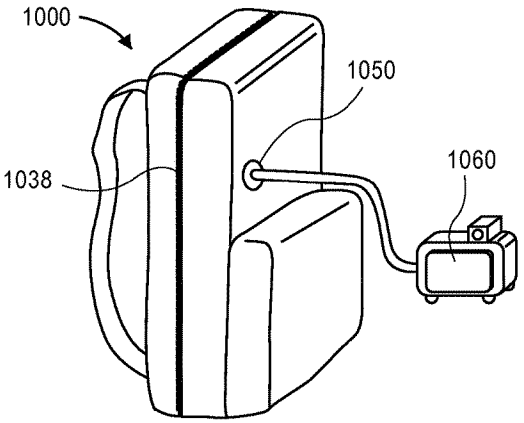
FIGS. 10A through 10C are views of aspects of one air-padded container in accordance with embodiments of the present disclosure.
Figure 10C:
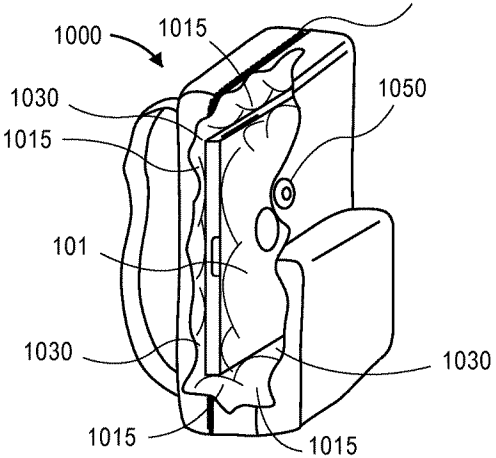
Figure 10A:
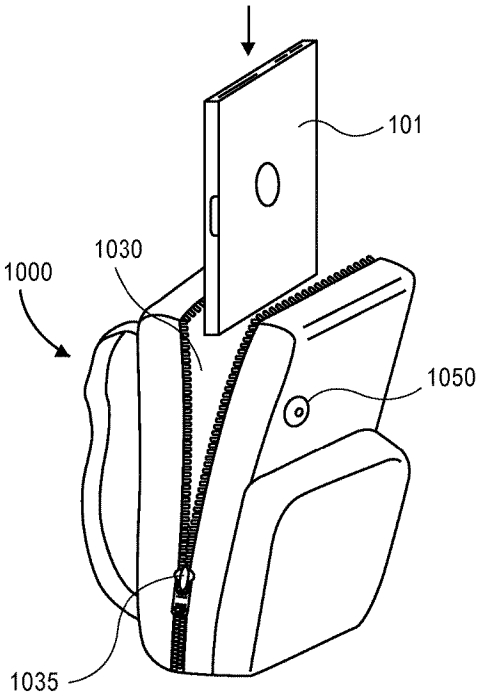

Furthermore, the air-padded containers of the present disclosure need not be limited to containers intended for delivery via mail or a traditional common carrier. For example, any type or form of carrying device, such as an article of luggage (e.g., a handbag), for providing customizable, lightweight and flexible dunnage therein. Referring to FIGS. 10A through 10C, views of aspects of one air-padded container 1000 in accordance with embodiments of the present disclosure are shown. Except where otherwise noted, reference numerals preceded by the number "10" shown in FIGS. 10A through 10C indicate components or features that are similar to components or features having reference numerals preceded by the number "9" shown in FIGS. 9A through 9C, by the number "8" shown in FIGS. 8A through 8E, by the number "7" shown in FIGS. 7A and 7B, by the number "5" shown in FIGS. 5A through 5C, by the number "4" shown in FIGS. 4A through 4C, by the number "3" shown in FIGS. 3A and 3B, by the number "2" shown in FIGS. 2A through 2F or by the number "1" shown in FIGS. 1A through 1E.

As is shown in FIGS. 10A through 10C, the container 1000 is a backpack formed from leather, canvas or like natural or synthetic materials and including one or more straps or other supporting means. The container 1000 is lined with one or more flexible layers 1030 of durable plastic or rubber along an interior surface of the container 1000, and includes a zipper 1035. When the container 1000 is opened, an item 100 (e.g., a mobile device such as a laptop computer or tablet computer) may be inserted therein, and the container 1000 may be closed with the item 100 therein using the zipper 1035.

Subsequently, a pressure source 1060 may be aligned to charge air or another suitable fluid into an inflatable reservoir 1015 defined by the one or more flexible layers 1030 and an interior surface of the container 1000 via an inflating valve 1050. As the inflatable reservoir 1015 fills with air, the container 1000 expands to accommodate the increasing volume of the inflatable reservoir 1015, which forms a barrier around the item 100 within the container 1000. When the pressure within the inflatable reservoir 1015 reaches a predetermined threshold or desired level, the charging may be secured, and the pressure source 1060 may be removed from the inflating valve 1050. The container 1000 may thus be carried or worn to an intended destination, with the item 100 shielded by the inflatable reservoir 1015 therein.

Therefore, unlike traditional luggage or bags, which are typically not lined with any form of dunnage, the container 1000 may provide a lightweight and suitable protective layer to protect items therein against damage by inflating the inflatable bladder 1015 with air or another fluid. Moreover, when the inflatable bladder 1015 is inflated to a predetermined pressure, the container 1000 may define a consistent exterior shape and volume regardless of the number, type or size of the items sealed therein. Attributes of one or more materials from which the container 1000 and the flexible layers 1030 are formed may be selected according to one or more standards or requirements, including such standards or requirements which may relate to the intended use of the container 1000, the environments in which the container 1000 is to expected to be used, or the masses, volumes, surface areas or other attributes of the items 100 that are expected to be stored or transported therein.

The systems and methods of the present disclosure may be further utilized to secure items within vehicles that are configured to transport such items over long distances. In accordance with the present disclosure, one or more cargo bays, volumes, compartments or other spaces of a vehicle may be lined with inflatable reservoirs, and one or more items, e.g., bags, barrels, bins, boxes, cartons, crates, envelopes, luggage, or tubes, may be placed into such spaces at a source. After the spaces are sealed with the one or more items therein, the inflatable reservoirs may be charged with air, and may secure the one or more items in place without requiring the use of straps, belts or other features. The vehicle may then travel from the source to a destination, where the air may be released from the reservoirs, and the items removed from their respective spaces.

Figure 11A:
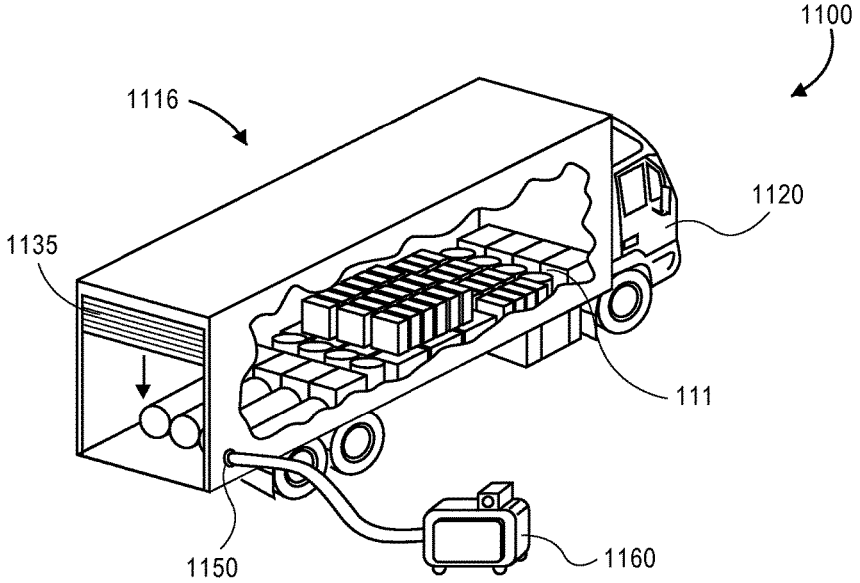
FIGS. 11A and 11B are views of aspects of one air-padded container in accordance with embodiments of the present disclosure.
Figure 11B:
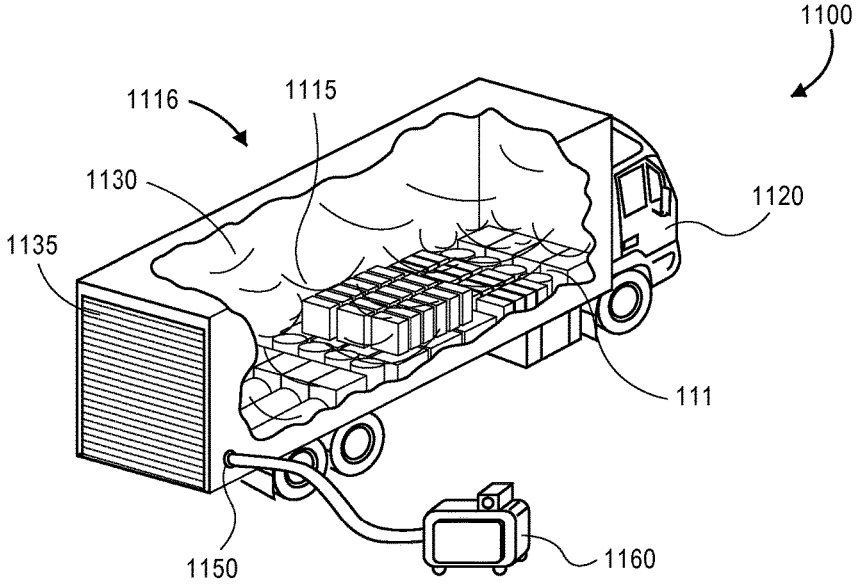

Referring to FIGS. 11A and 11B, views of aspects of one system 1100 including an air-padded container in accordance with embodiments of the present disclosure are shown. Except where otherwise noted, reference numerals preceded by the number "11" shown in FIGS. 11A and 11B indicate components or features that are similar to components or features having reference numerals preceded by the number "10" shown in FIGS. 10A through 10C, by the number "9" shown in FIGS. 9A through 9C, by the number "8" shown in FIGS. 8A through 8E, by the number "7" shown in FIGS. 7A and 7B, by the number "5" shown in FIGS. 5A through 5C, by the number "4" shown in FIGS. 4A through 4C, by the number "3" shown in FIGS. 3A and 3B, by the number "2" shown in FIGS. 2A through 2F or by the number "1" shown in FIGS. 1A through 1E.

As is shown in FIGS. 11A and 11B, the system 1100 includes a trailer 1110 and a tractor 1120 other road vehicle configured to transport items. The trailer 1110 includes a plurality of items 111 (e.g., boxes, cartons or the like) therein and is lined with a plurality of flexible layers 1130 which define inflatable reservoirs 1115 with interior walls of the trailer 1110. Referring to FIG. 11A, after the items 111 have been placed therein, the trailer 1110 may be sealed by closing a roll-up door 1135, and the inflatable reservoirs 1115 may be charged with air from an external pressure source 1160 via an inflating valve 1150.

Referring to FIG. 11B, when the inflatable reservoirs 1115 have been charged with air, the inflatable reservoirs 1115 press against each of the plurality of items 111 and thereby restrict the movement of such items therein, when the trailer 1110 and/or the tractor 1120 are in motion. Thus, the materials of the flexible layers 1130 from which the inflatable reservoirs 1115 are formed, and the pressures within the inflatable reservoirs 1115, may be selected to ensure that such items 111 remain in fixed or stable conditions while in transit. After the trailer 1110 arrives at a destination, the inflatable reservoirs 1115 may be depressurized, the roll-up door 1135 may be opened, and the plurality of items 111 may be removed from the trailer 1110.

Figure 12A:
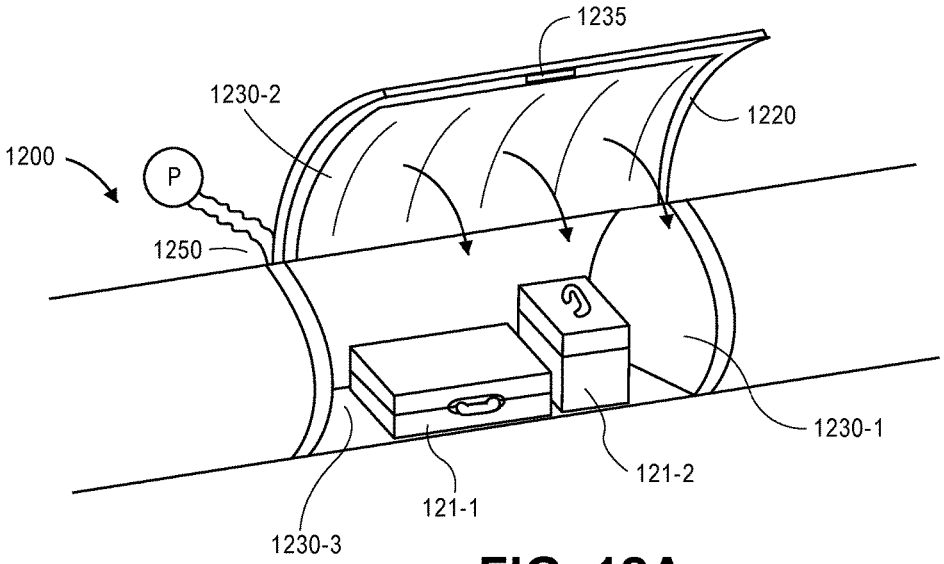
FIGS. 12A and 12B are views of aspects of one air-padded container in accordance with embodiments of the present disclosure.
Figure 12B:
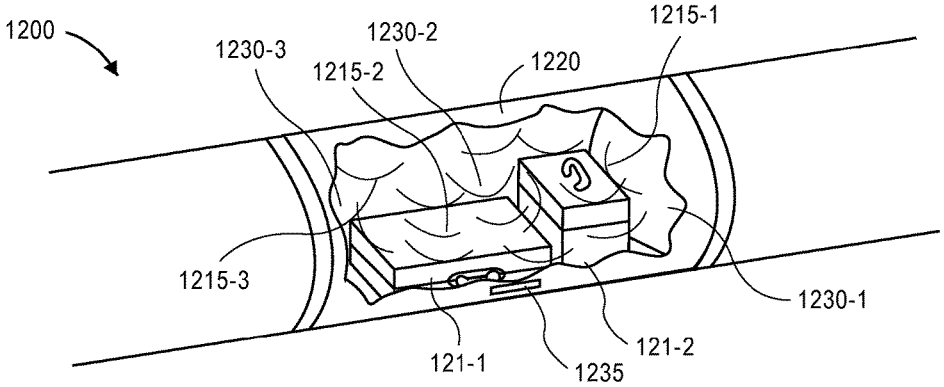

The systems and methods of the present disclosure may be utilized to secure items within any type of vehicle or craft traveling on land, sea or air. Referring to FIGS. 12A and 12B, views of aspects of one system 1200 including an air-padded container in accordance with embodiments of the present disclosure are shown. Except where otherwise noted, reference numerals preceded by the number "12" shown in FIGS. 12A and 12B indicate components or features that are similar to components or features having reference numerals preceded by the number "11" shown in FIGS. 11A and 11B, by the number "10" shown in FIGS. 10A through 10C, by the number "9" shown in FIGS. 9A through 9C, by the number "8" shown in FIGS. 8A through 8E, by the number "7" shown in FIGS. 7A and 7B, by the number "5" shown in FIGS. 5A through 5C, by the number "4" shown in FIGS. 4A through 4C, by the number "3" shown in FIGS. 3A and 3B, by the number "2" shown in FIGS. 2A through 2F or by the number "1" shown in FIGS. 1A through 1E.

As is shown in FIGS. 12A and 12B, the system 1200 includes an overhead compartment 1210 that may be installed on an airplane, a sailing ship, a train, a bus or any other form of transit. The overhead compartment 1210 includes a plurality of items 121-1, 121-2 therein, and is equipped with a folding door 1220 having a latch 1235. The overhead compartment 1210 is lined with a plurality of flexible layers 1230-1, 1230-2, 1230-3 which define inflatable reservoirs 1215-1, 1215-2, 1215-3 along interior walls of the overhead compartment 1210.

Referring to FIG. 12A, after the items 121-1, 121-2 have been deposited within the overhead compartment 1210, the folding door 1220 may be closed with the latch 1235, and the inflatable reservoirs 1215-1, 1215-2, 1215-3 may be charged with air from an external pressure source via one or more inflating valves 1250.

Referring to FIG. 12B, when the inflatable reservoirs 1215-1, 1215-2, 1215-3 have been charged with air, the inflatable reservoirs 1215 press down upon and around each of the plurality of items 121-1, 121-2 and thereby restrict their movement within the overhead compartment 1210. Subsequently, the inflatable reservoirs 1215-1, 1215-2, 1215-3 may be depressurized, the folding door 1220 may be opened, and the plurality of items 121-1, 121-2 may be removed from the overhead compartment 1210.

Although the disclosure has been described herein using exemplary techniques, components, and/or processes for implementing the systems and methods of the present disclosure, it should be understood by those skilled in the art that other techniques, components, and/or processes or other combinations and sequences of the techniques, components, and/or processes described herein may be used or performed that achieve the same function(s) and/or result(s) described herein and which are included within the scope of the present disclosure.

For example, although some of the embodiments disclosed herein reference the use of containers to deliver items from warehouses or other like facilities, those of ordinary skill in the pertinent arts will recognize that the present disclosure is not so limited, and that embodiments of the present disclosure may be utilized to transport or store items within air-padded containers of any kind that are lined with one or more inflatable reservoirs and transported from any source to any destination, or stored in any location or setting, including one or more fixed or moving areas or spaces. Additionally, although some of the embodiments disclosed herein refer to containers in standard shapes of rectangular solids or prisms, the present disclosure is likewise not so limited, and embodiments of the present disclosure may be formed in non-traditional shapes, e.g., the cylindrical container 800 of FIGS. 8A through 8E or the padded envelope container 900 of FIGS. 9A through 9C, or any other air-padded containers of any shape or size. Furthermore, although some of the embodiments disclosed herein refer to the use of inflatable reservoirs in vehicles such as trucks or airplanes, the present disclosure is also not so limited, and one or more of the inflatable reservoirs disclosed herein may be used with any type or form of vehicle.

Moreover, although some of the embodiments disclosed herein depict the transportation or storage of a single item within air-padded containers, those of ordinary skill in the pertinent arts will recognize that the air-padded containers of the present disclosure may be used to transport or store any number (e.g., one or more) of such items therein. Furthermore, although some of the embodiments disclosed herein reference the charging of inflatable reservoirs with air (e.g., consisting essentially of nitrogen, oxygen and other common atmospheric gases), those of ordinary skill in the pertinent arts will recognize that some of the containers of the present disclosure may include inflatable reservoirs that may be charged with any suitable fluid (e.g., homogenous gases or liquids, or heterogeneous mixtures of gases or liquids, of any suitable volume, mass or density) in accordance with the present disclosure.

It should be understood that, unless otherwise explicitly or implicitly indicated herein, any of the features, characteristics, alternatives or modifications described regarding a particular embodiment herein may also be applied, used, or incorporated with any other embodiment described herein, and that the drawings and detailed description of the present disclosure are intended to cover all modifications, equivalents and alternatives to the various embodiments as defined by the appended claims. Moreover, with respect to the one or more methods or processes of the present disclosure described herein, including but not limited to the flow chart shown in FIG. 6, orders in which such methods or processes are presented are not intended to be construed as any limitation on the claimed inventions, and any number of the method or process steps or boxes described herein can be combined in any order and/or in parallel to implement the methods or processes described herein. Also, the drawings herein are not drawn to scale.

Conditional language, such as, among others, "can," "could," "might," or "may," unless specifically stated otherwise, or otherwise understood within the context as used, is generally intended to convey in a permissive manner that certain embodiments could include, or have the potential to include, but do not mandate or require, certain features, elements and/or steps. In a similar manner, terms such as "include," "including" and "includes" are generally intended to mean "including, but not limited to." Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

The elements of a method, process, or algorithm described in connection with the embodiments disclosed herein can be embodied directly in computer hardware, in a software module stored in one or more memory devices and executed by one or more processors, or in a combination of the two. A software module can reside in RAM, flash memory, ROM, EPROM, EEPROM, registers, a hard disk, a removable disk, a CD-ROM, a DVD-ROM or any other form of non-transitory computer-readable storage medium, media, or physical computer storage known in the art. An example storage medium can be coupled to the processor such that the processor can read information from, and write information to, the storage medium. In the alternative, the storage medium can be integral to the processor. The storage medium can be volatile or nonvolatile. The processor and the storage medium can reside in an application-specific integrated circuit, or ASIC, which can reside in a user terminal. In the alternative, the processor and the storage medium can reside as discrete components in a user terminal.

Disjunctive language such as the phrase "at least one of X, Y, or Z," or "at least one of X, Y and Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

Language of degree used herein, such as the terms "about," "approximately," "generally," "nearly" or "substantially" as used herein, represent a value, amount, or characteristic close to the stated value, amount, or characteristic that still performs a desired function or achieves a desired result. For example, the terms "about," "approximately," "generally," "nearly" or "substantially" may refer to an amount that is within less than 10% of, within less than 5% of, within less than 1% of, within less than 0.1% of, and within less than 0.01% of the stated amount.

Although the invention has been described and illustrated with respect to illustrative embodiments thereof, the foregoing and various other additions and omissions may be made therein and thereto without departing from the spirit and scope of the present disclosure.

What is claimed is:

1. A container blank comprising:

a first substrate comprising a plurality of panels, wherein each of the plurality of panels includes an inner surface and an outer surface;

a first flexible layer having a first shape, wherein at least a portion of a perimeter of the first flexible layer is adhered to inner surfaces of at least some of the plurality of panels of the first substrate by one of a glue or a heat seal, wherein at least one inflatable reservoir is formed at least in part by the first flexible layer and the inner surfaces of the at least some of the plurality of panels of the first substrate;

at least one hole extending through a first panel of the plurality of panels; and at least one valve aligned with the at least one hole, wherein the at least one valve comprises an inlet associated with a first outer surface of the first panel and an outlet extending into the at least one inflatable reservoir.

2. The container blank of claim 1, wherein the at least one valve comprises a self-sealing perforation of the first flexible layer aligned with the at least one hole.

3. The container blank of claim 1, wherein the at least one inflatable reservoir comprises a first inflatable reservoir formed at least in part by the first flexible layer and a second flexible layer and a second inflatable reservoir formed at least in part by a third flexible layer adhered to at least a third portion of a second inner surface of a second panel of the plurality of panels and a fourth flexible layer adhered to at least a fourth portion of the third flexible layer, wherein the at least one hole comprises a first hole extending through the first panel and a second hole extending through the first panel, wherein the at least one valve comprises a first valve aligned with the first hole and a second valve aligned with the second hole, wherein the first valve comprises a first inlet associated with the first outer surface of the first panel and a first outlet extending into the first inflatable reservoir, and wherein the second valve comprises a second inlet associated with a second outer surface of the second panel and a second outlet extending into the second inflatable reservoir.

4. The container blank of claim 1, wherein the first substrate comprises a scored line between the first panel and a second panel of the plurality of panels, and wherein the first flexible layer is adhered to at least a portion of the scored line.

5. The container blank of claim 1, further comprising:

wherein the inlet is adapted to mate with at least one of a pump outlet or an oral inflation device.

6. The container blank of claim 1, wherein the at least one valve is a check valve aligned to permit flow in a first direction from a first region bounded by the outer surface to a second region within the at least one inflatable reservoir, and wherein the check valve is aligned to restrict flow in a second direction from the second region to the first region.

7. The container blank of claim 1, wherein the first substrate is formed from at least one of:

a card stock;

a paperboard;

a corrugated fiberboard;

a paper;

a canvas;

a woven fabric comprising one or more plastic fibers;

a woven fabric comprising one or more cotton fibers;

a woven fabric comprising one or more paper fibers;

a non-woven fabric comprising at least one of polypropylene or polyethylene;

a metal;

a leather; or a plastic.

8. A container blank comprising:

a first substrate comprising a plurality of panels, wherein each of the plurality of panels includes an inner surface and an outer surface;

a first flexible layer having a first shape, wherein at least a portion of a perimeter of the first flexible layer is adhered to inner surfaces of at least some of the plurality of panels of the first substrate by one of a glue or a heat seal;

a second flexible layer having the first shape, wherein at least a portion of a perimeter of the second flexible layer is adhered to one side of the first flexible layer by one of the glue or the heat seal, and wherein at least one inflatable reservoir is formed between the first flexible layer and the second flexible layer;

at least one hole extending through a first panel of the plurality of panels; and at least one valve aligned with the at least one hole, wherein the at least one valve comprises an inlet associated with a first outer surface of the first panel and an outlet extending into the at least one inflatable reservoir.

9. The container blank of claim 1, wherein the first substrate is formed from a first material, and wherein the first flexible layer is formed from the first material.

10. The container blank of claim 1, wherein the first substrate comprises the first panel, a second panel, a third panel, a fourth panel, a sealing panel joined to the fourth panel, a first score between the first panel and the second panel, a second score between the second panel and the third panel, a third score between the third panel and the fourth panel and a fourth score between the fourth panel and the sealing panel, wherein the portion of the perimeter of the first flexible layer is adhered to the perimeter of the first substrate on each of the first panel, the second panel, the third panel or the fourth panel, and wherein the container blank forms a first box when the container blank is folded about the first score, the second score, the third score and the fourth score, and when the sealing panel is joined to the first panel.

11. The container blank of claim 1, wherein the first panel is a first rectangular section having a first edge and a second edge, wherein the first substrate further comprises a sealing panel joined to the second edge;

wherein the first flexible layer is adhered about a perimeter of the first inner surface, and wherein the container blank forms a first tube when the first rectangular section is rolled to join the sealing panel to the first edge of the first rectangular section.

12. The container blank of claim 8, wherein at least one of the first flexible layer or the second flexible layer comprises at least one layer of a polypropylene or a polyethylene.

* * * * *